US012286921B2

(12) United States Patent
Ito et al.

(10) Patent No.: US 12,286,921 B2
(45) Date of Patent: Apr. 29, 2025

(54) EXHAUST GAS CONTROL APPARATUS FOR INTERNAL COMBUSTION ENGINE

(71) Applicant: TOYOTA JIDOSHA KABUSHIKI KAISHA, Toyota (JP)

(72) Inventors: Hirokazu Ito, Shizuoka-ken (JP); Kazuhiko Seguchi, Shizuoka-ken (JP); Hiroshi Oyagi, Kyoto (JP); Akira Hojo, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/472,613

(22) Filed: Sep. 22, 2023

(65) Prior Publication Data

US 2024/0183301 A1 Jun. 6, 2024

(30) Foreign Application Priority Data

Dec. 1, 2022 (JP) ..... 2022-192782

(51) Int. Cl.

| | |
|---|---|
| ***F01N 3/22*** | (2006.01) |
| ***F01N 3/20*** | (2006.01) |
| ***F01N 13/06*** | (2010.01) |
| ***F01N 13/10*** | (2010.01) |

(52) U.S. Cl.

CPC ..... *F01N 3/225* (2013.01); *F01N 3/2066* (2013.01); *F01N 13/06* (2013.01); *F01N 13/10* (2013.01); *F01N 13/105* (2013.01); *F01N 13/107* (2013.01); *F01N 2240/20* (2013.01); *F01N 2260/14* (2013.01); *F01N 2260/16* (2013.01)

(58) Field of Classification Search

CPC combination set(s) only.

See application file for complete search history.

(56) References Cited

U.S. PATENT DOCUMENTS

| | | | | |
|---|---|---|---|---|
| 6,082,103 | A * | 7/2000 | Sugiura | F01N 13/08 60/272 |
| 2009/0288405 | A1* | 11/2009 | Shibasaki | F01N 13/1838 60/323 |
| 2010/0000201 | A1* | 1/2010 | Hoshi | F01N 13/008 60/276 |
| 2010/0112878 | A1* | 5/2010 | White | F01N 13/105 440/89 H |

(Continued)

FOREIGN PATENT DOCUMENTS

| | | | |
|---|---|---|---|
| JP | H11-173145 | A | 6/1999 |
| JP | 2007-13881 | A | 6/2007 |
| JP | 2014-211111 | A | 11/2014 |

*Primary Examiner* — Binh Q Tran

(74) *Attorney, Agent, or Firm* — SoraIP, Inc.

(57) ABSTRACT

In an exhaust gas control apparatus for an internal combustion engine in which a catalytic converter is attached to an engine having a plurality of cylinders and a plurality of exhaust passages communicating with the plurality of cylinders, a diffusion portion that promotes a jet flow of a main flow of the exhaust gas flowing into the merging portion is provided at a merging portion connected to a downstream side of the exhaust passage. Further, on the inner wall of the merging portion facing the inlet of the exhaust gas provided in the exhaust passage, a dispersion face for three-dimensionally dispersing the main flow of the exhaust gas flowing linearly into the merging portion from the inlet is formed.

10 Claims, 16 Drawing Sheets

(56) References Cited

U.S. PATENT DOCUMENTS

| | | | | |
|---|---|---|---|---|
| 2010/0126158 | A1* | 5/2010 | Murakami | F01N 13/08 60/323 |
| 2013/0098009 | A1* | 4/2013 | Seeger | F01N 13/10 60/323 |
| 2014/0338308 | A1* | 11/2014 | Moetakef | F01N 1/086 60/273 |
| 2018/0266302 | A1* | 9/2018 | Kato | F01N 13/10 |

* cited by examiner

EXHAUST GAS CONTROL APPARATUS FOR INTERNAL COMBUSTION ENGINE

CROSS-REFERENCE TO RELATED APPLICATION

This application claims priority to Japanese Patent Application No. 2022-192782 filed on Dec. 1, 2022 incorporated herein by reference in its entirety.

BACKGROUND

1. Technical Field

The disclosure relates to an exhaust gas control apparatus for an internal combustion engine, and more particularly, to an exhaust gas control apparatus for an internal combustion engine in which a catalytic converter is provided in an immediate vicinity of an engine having an exhaust passage communicating with a plurality of cylinders.

2. Description of Related Art

In an exhaust gas control apparatus for an internal combustion engine of this type, there are cases in which a catalytic converter disposed in an immediate vicinity of an engine has to be disposed largely offset from a middle portion in a cylinder row direction. Japanese Unexamined Patent Application Publication No. 2014-211111 (JP 2014-211111 A) is disclosed as technology for guiding exhaust gas into a catalytic converter in a well-balanced manner, even when the catalytic converter disposed in the immediate vicinity of the engine is largely offset in this way.

JP 2014-211111 A discloses technology in which exhaust gas flows flowing through each of a plurality of exhaust passages in a state of being aligned along the cylinder row, which are a first exhaust passage, a second exhaust passage, a third exhaust passage, and a fourth exhaust passage, are each guided by swirling toward the catalytic converter by a swirling structure provided in a manifold portion disposed between the first exhaust passage and the second exhaust passage.

According to JP 2014-211111 A, even when the catalytic converter is disposed largely offset, the exhaust gas can be guided into the catalytic converter in a well-balanced manner.

SUMMARY

However, in JP 2014-211111 A, the flow is deviated to an outer side of a pipe due to generation of a swirling flow, and accordingly there is a concern that a catalyst middle portion may not be effectively utilized. Also, in JP 2014-211111 A, the manifold portion is disposed between the first exhaust passage and the second exhaust passage, and accordingly the flow rate of the exhaust gas flowing through the first exhaust passage and the second exhaust passage is high, and the time of retention thereof in the catalyst becomes short. Accordingly, there is a need to increase the size of the catalyst in order to ensure control capabilities, but there is a concern that pressure loss of the exhaust gas control system will increase overall.

The disclosure has been made in view of the above circumstances, and an object thereof is to provide an exhaust gas control apparatus for an internal combustion engine capable of improving purification characteristics without increasing the size of the catalyst.

In order to solve the above problem, according to a first aspect of the disclosure, in an exhaust gas control apparatus for an internal combustion engine, the internal combustion engine is equipped with a catalytic converter attached to an engine including a plurality of cylinders and one or a plurality of exhaust passages communicating with the cylinders, and a merging portion connected to a downstream side of the exhaust passage is provided with a diffusion portion that promotes a jet flow of a main flow of exhaust gas flowing into the merging portion. The diffusion portion may be configured by a protruding portion at which a downstream end portion of the exhaust passage protrudes into the merging portion. The diffusion portion may be configured by a stepped portion at which the merging portion expands with respect to the exhaust passage, at a connecting portion between the exhaust passage and the merging portion.

According to this configuration, in the merging portion where the exhaust passages from the cylinders merge, flow of the exhaust gas stagnating at a wall side of the exhaust passage is separated from the wall by the jet flow of the main flow of the exhaust gas flowing into the merging portion, and surrounding stationary gas is entrained, whereby the flow can be diffused. As a result, the flow rate of the exhaust gas decreases, and flow in a direction of the catalyst can be reduced.

Further, according to a second aspect of the disclosure, in an exhaust gas control apparatus for an internal combustion engine, the internal combustion engine is equipped with a catalytic converter attached to an engine including a plurality of cylinders and one or a plurality of exhaust passages communicating with the cylinders. In a merging portion connected to a downstream side of the exhaust passage, a dispersion face is provided on an inner wall of the merging portion opposed to an inflow port of exhaust gas provided on the exhaust passage, the dispersion face three-dimensionally dispersing a main flow of exhaust gas linearly flowing into the merging portion from the inflow port.

According to this configuration, in the merging portion where the exhaust passages from the cylinders merge, the main flow of the exhaust gas flowing into the merging portion collides with the inner wall of the merging portion opposed to the inflow port, and the flow can be three-dimensionally dispersed with respect to the colliding portion. Thus, the flow rate of the exhaust gas decreases, and the flow in the catalyst direction can be reduced.

In the exhaust gas control apparatus according to the second aspect, when the exhaust passage is connected to the merging portion via a bent portion, the dispersion face of the merging portion may be provided such that the dispersion face is substantially orthogonal to an axis along an outer wall of the bent portion.

The merging portion connected to the downstream side of the exhaust passage that includes the bent portion may be provided with a diffusion portion that promotes a jet flow of the main flow of the exhaust gas flowing into the merging portion. The diffusion portion may be configured by a protruding portion at which a downstream end portion of the exhaust passage protrudes into the merging portion.

According to such a configuration, the exhaust gas flowing through the exhaust passage flows along the outer wall of the bent portion, and the main flow of the exhaust gas flowing into the merging portion collides with the dispersion face substantially orthogonal to the axis along the outer wall of the bent portion, thereby three-dimensionally dispersing the flow, and thus reducing the flow rate of the exhaust gas.

Also, by providing the diffusion portion that promotes a jet flow of the main flow of the exhaust gas flowing into the merging portion, at the merging portion to which the exhaust passage having the bent portion is connected, the flow of the exhaust gas stagnating at the wall side of the exhaust passage is separated from the wall, and also the surrounding stationary gas is entrained, whereby the flow can be diffused. As a result, the flow rate of the exhaust gas decreases, and the flow in the direction of the catalyst can be reduced.

Also, in the exhaust gas control apparatus according to the second aspect, the dispersion face in the merging portion may be configured by an inclined face of which an upper side is obtuse in a direction perpendicular to the exhaust passage.

According to this configuration, a dispersion direction of the exhaust gas can be guided upward, and the flow in the direction of the catalyst can be further reduced.

Also, in the exhaust gas control apparatus according to the second aspect, the exhaust passage may include a manifold exhaust passage provided with a wall on an extension line of each center axis of the exhaust passages, and the manifold exhaust passage may be connected to the merging portion.

According to such a configuration, the exhaust gas flowing through the exhaust passage collides with the wall of the manifold exhaust passage and is dispersed, whereby variance in distribution of the exhaust gas flowing through the exhaust passages can be suppressed. Further, at the merging portion, the main flow of the exhaust gas of which the variance in distribution is suppressed collides with the inner wall of the merging portion opposed to the inflow port and the flow is three-dimensionally dispersed, whereby the flow rate of the exhaust gas can be further reduced.

Also, in the exhaust gas control apparatus according to the second aspect, the merging portion connected to the downstream side of the manifold exhaust passage may be provided with a diffusion portion that promotes a jet flow of the main flow of the exhaust gas.

In this case, the main flow of the exhaust gas flowing into the merging portion can be made to be a jet flow, and the surrounding stationary gas is entrained and the flow rate is reduced. In other words, by making the main flow of the exhaust gas to be a jet flow, the flow of the exhaust gas stagnating at the wall side of the exhaust passage is separated from the wall of the exhaust passage, and also the surrounding stationary gas is entrained, whereby the flow is diffused and flow rate can be reduced.

Also, in the exhaust gas control apparatus according to the first aspect or the second aspect, an air-fuel ratio sensor may be provided at a portion of the merging portion where the main flows of the exhaust gas flowing into the merging portion from the exhaust passages merge.

According to this configuration, the exhaust gas discharged from each cylinder collides with the air-fuel ratio sensor in a state with a high flow rate, and accordingly sensor responsivity can be ensured.

According to the disclosure, in the merging portion connected to the downstream side of the exhaust passages communicating with the respective cylinders, the main flow of the exhaust gas is diffused or dispersed so as to reduce the flow rate, and the flow rate of the exhaust gas passing through the catalyst can be reduced, whereby the purification characteristics can be improved without increasing the size of the catalyst.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, embodiments of the present disclosure will be described in detail with reference to the accompanying drawings.

Here, an exhaust gas control apparatus of an internal combustion engine including an engine of a series cylinder will be described.

First Embodiment

Figure 1A:
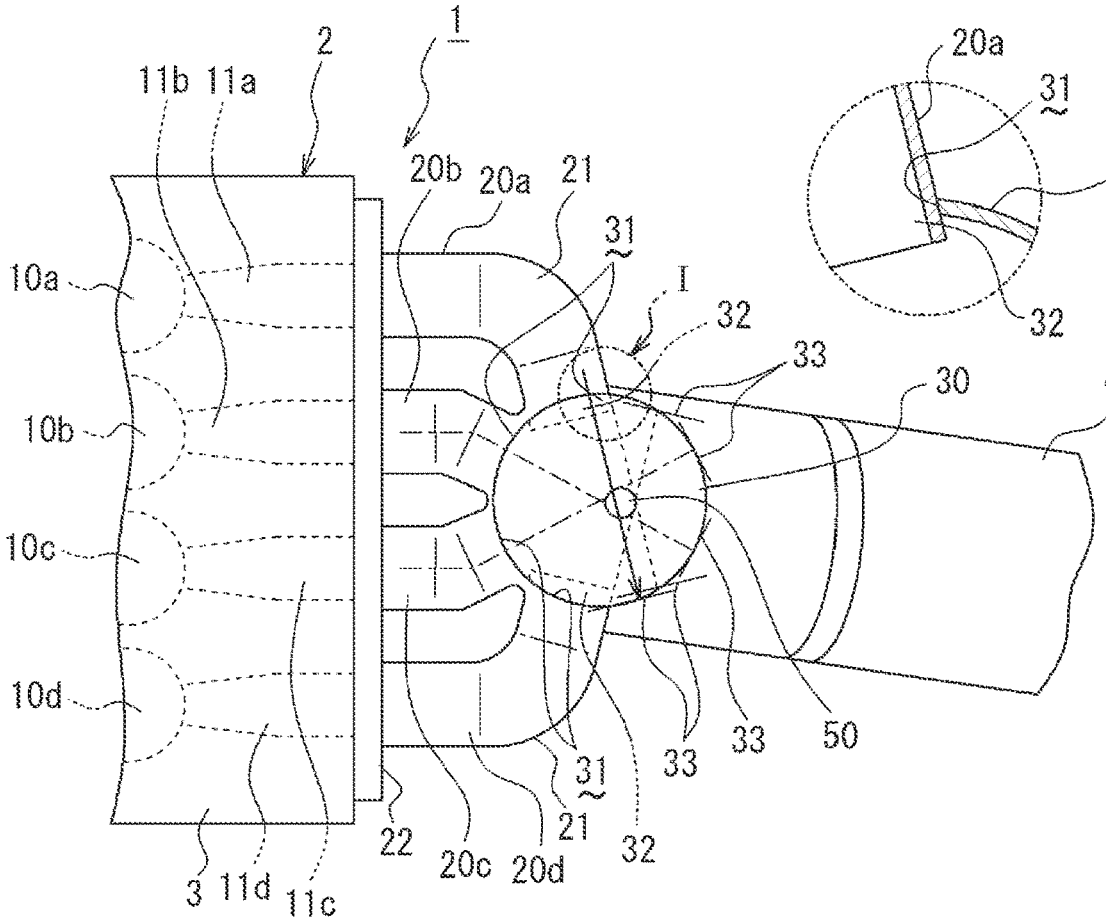
FIG. 1A is a schematic plan view showing a first embodiment of an exhaust gas control apparatus according to the present disclosure.
Figure 1B:
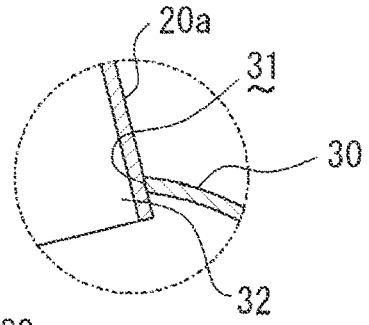
FIG. 1B is an enlarged sectional view of a portion I of a schematic plan view showing a first embodiment of an exhaust gas control apparatus according to the present disclosure.
Figure 2:
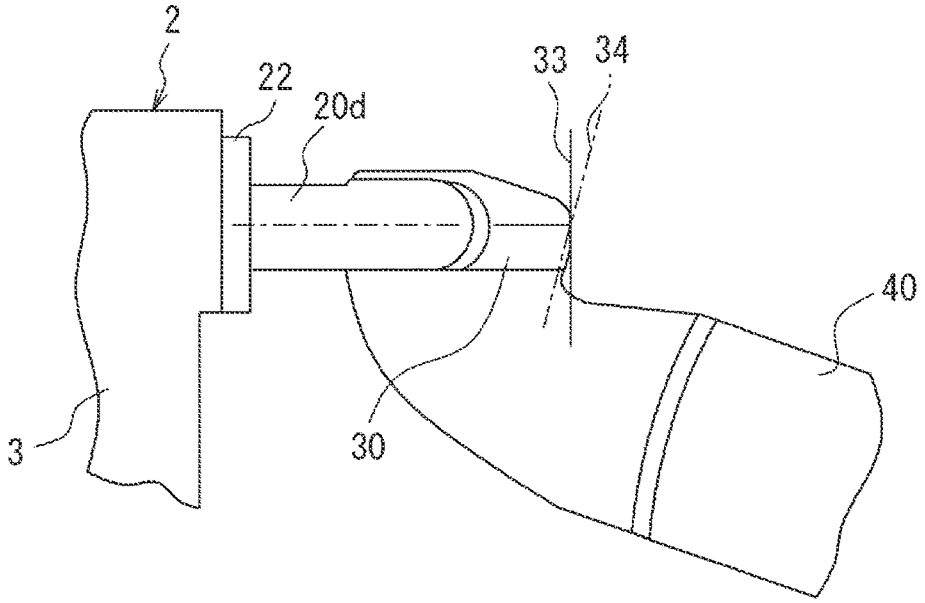
FIG. 2 is a schematic side view of the exhaust gas control apparatus of the first embodiment.

Exhaust gas control apparatus 1 of an internal combustion engine according to the present disclosure, as shown in FIGS. 1A, 1B, and 2, a merging portion 30 is connected to a downstream side of the exhaust passages 20*a* to 20*d* formed of first to fourth exhaust pipes communicating with a plurality of, i.e., first to fourth cylinder 10*a*, 10*b*, 10*c*, 10*d* in series (hereinafter referred to as first to fourth cylinder 10*a*, 10*b*, 10*c*, 10*d*) provided in cylinder head 3 of engine 2, and a catalytic converter 40 is connected to a downstream side below merging portion 30.

The engine 2 communicates with the respective cylinders 10*a* to 10*d* provided in the cylinder head 3, and one end of 11*d* is horizontally opened from the first to fourth exhaust ports 11*a* for discharging the exhaust gases generated in the respective cylinders 10*a* to 10*d*. Note that, in FIGS. 1A and 1B, the cylinder row is constituted by the first cylinder 10*a*, second cylinder 10*b*, third cylinder 10*c* and the fourth cylinder 10*d* in order from the upper end side toward the lower end side. The first to fourth exhaust ports 11*a* to 11*d* correspond to each of 10*d* from the first to fourth cylinder 10*a*.

From the first to fourth cylinders 10*a* to 10*d*, for example, the first cylinder 10*a*, the third cylinder 10*c*, the fourth cylinder 10*d*, and the second cylinder 10*b* are repeatedly burned while being shifted in the order of the timings. Therefore, from the first to fourth exhaust ports 11*a* to 11*d*, the exhaust gases are continuously discharged from each of to the exhaust ports 11*a* to 11*d* while being shifted in timing.

Each of the first to fourth exhaust passages 20*a* to 20*d* is connected at its upstream end to a mounting flange 22 fixed to the cylinder head 3 and communicates with the corresponding first to fourth cylinder 10*a* to 10*d* via a the first to fourth exhaust port 11*a* to 11*d*. The first to fourth exhaust passages 20*a* to 20*d* extend rearward away from the engine 2 at regular intervals laterally along the cylinder row. The downstream-side end portions of 20*d* from the first to fourth exhaust passages 20*a* are connected to the merging portion 30 and are in communication with each other. The merging portion 30 is disposed at a position intermediate from the first to fourth exhaust ports 11*a* to 11*d* with respect to the cylinder head 3.

Of the first to fourth exhaust passages 20*a* to 20*d*, the first exhaust port 11*a* and the fourth exhaust port 11*d* are arranged symmetrically with respect to an imaginary line (not shown) connecting the middle of the cylinder head 3 and the central portion of the merging portion 30, and the leading end sides of the straight portions extending rearward from the cylinder head 3 are connected to the merging portion 30 through the bent portion 21. The downstream end portion of the first exhaust passage 20*a* and the downstream end portion of the fourth exhaust port 11*d* protrude into the merging portion 30 to form a diffusion portion 32 to be described later.

The second exhaust passage 20*b* and the third exhaust passage 20*c* are arranged symmetrically with respect to an imaginary line (not shown) connecting the middle of the cylinder head 3 and the central portion of the merging portion 30, and are bent slightly toward the rear of the engine 2 to be connected to the merging portion 30.

The merging portion 30 is provided with an inflow port 31 to which each of the first to fourth exhaust passages 20*a* to 20*d* is connected, and the end portion of the first exhaust port 11*a* and the end portion of the fourth exhaust port 11*d* connected to the inflow port 31 are protruded into the merging portion 30, thereby forming a diffusion portion 32 that promotes the jet flow of the main flow of the exhaust gas flowing into the merging portion 30 (see FIG. 1B). By forming the diffusion portion 32 in this manner, the flow of the exhaust gas stagnating toward the wall of the first exhaust port 11*a* and the fourth exhaust port 11*d* is separated from the wall by the jet of the main flow of the exhaust gas flowing into the merging portion 30 from the first exhaust port 11*a* and the fourth exhaust port 11*d*, and the surrounding stationary gas is entrained, whereby the flow can be diffused. As a result, the flow rate of the exhaust gas decreases, and the flow of the catalytic converter 40 in the catalytic direction can be reduced.

In the merging portion 30, on the inner wall of the merging portion 30 opposed to the inflow port 31 connecting the first exhaust port 11*a* and the fourth exhaust passage 20*d*, a dispersion face 33 is formed which three-dimensionally disperses the main flow of the exhaust gases linearly flowing from the inflow port 31 into the merging portion 30. Here, the dispersion face 33 is provided so as to be substantially perpendicular to the first exhaust port 11*a* and the shaft of the fourth exhaust port 11*d*. Further, the dispersion face 33 is provided so as to be substantially perpendicular to the first exhaust port 11*a* and the shaft along the outer wall of the bent portion 21 of the fourth exhaust passage 20*d*.

Further, in the merging portion 30, on the inner wall of the merging portion 30 opposed to the inflow port 31 connecting the second exhaust passage 20*b* and the third exhaust passage 20*c*, a dispersion face 33 is formed which three-dimensionally disperses the main flow of the exhaust gases flowing linearly from the inflow port 31 into the merging portion 30. Here, the dispersion face 33 is provided so as to be substantially perpendicular to the second exhaust passage

20*b* and the shaft of the third exhaust passage 20*c*. Note that, in FIGS. 1A and 1B, the dispersion face 33 is indicated by a straight line for clarity.

Further, as shown in FIG. 2, the dispersion face 33 is formed by an inclined surface 34 whose upper side is obtuse with respect to the dispersion face 33 along the vertical direction. By forming the dispersion face 33 with the inclined surface 34 having an obtuse upper side as described above, the dispersion direction of the exhaust gas can be guided upward, and the flow in the catalyst direction can be further reduced.

An air-fuel ratio sensor 50 for measuring an air-fuel ratio (A/F) of the exhaust gas flowing out of the respective cylinders 10*a* to 10*d* is provided at a portion where the main flow of the exhaust gas flowing into the merging portion 30 from the first to fourth exhaust passages 20*a* to 20*d* is alternating with each other in the merging portion 30. As described above, by providing the air-fuel ratio sensor 50 at a portion where the main flow of the exhaust gas flowing from the first to fourth exhaust passages 20*a* to 20*d* into the merging portion 30 is alternating with each other, the flow rate of the exhaust gas discharged from the respective cylinders 10*a* to 10*d* is fast and collides with the air-fuel ratio sensor 50, so that the sensor responsiveness can be secured. The measurement data detected by the air-fuel ratio sensor 50 is transmitted to a control unit (not shown), and the combustion condition of the cylinders 10*a* to 10*d* is controlled based on the measurement value by the control unit.

Next, in the exhaust gas control apparatus 1 of the first embodiment, the flow of the exhaust gas discharged from the respective cylinders 10*a* to 10*d* will be described referring to FIGS. 3A to 3F.

Figure 3A:
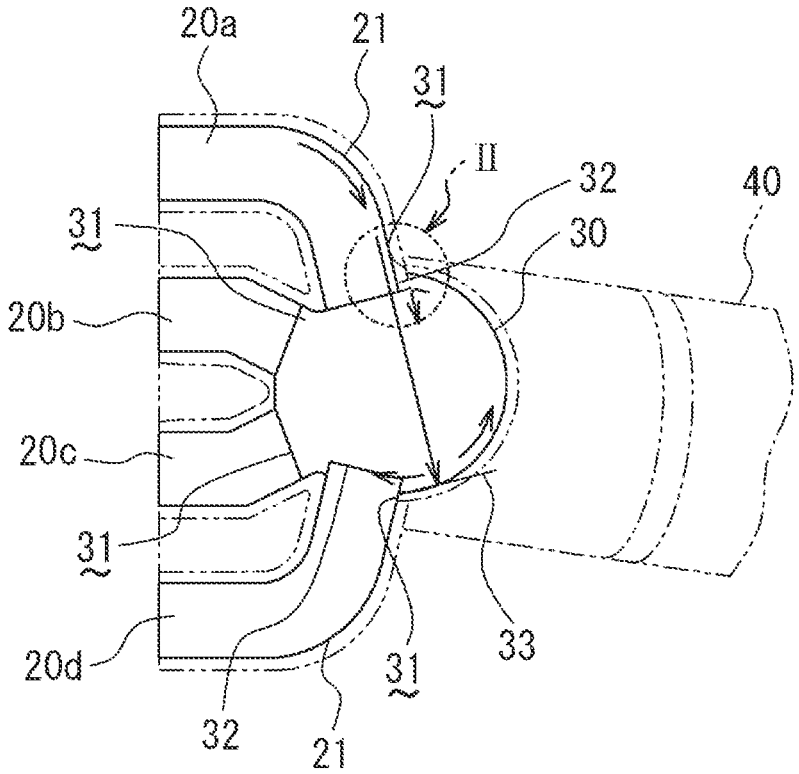
FIG. 3A is a schematic plan view illustrating a flow of exhaust gases of a first cylinder in an exhaust gas control apparatus according to a first embodiment.
Figure 3B:
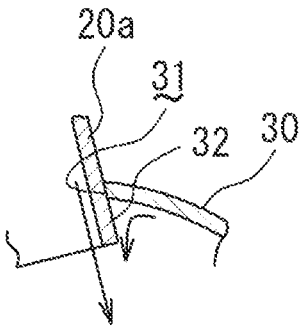
FIG. 3B is an enlarged cross-sectional view of a II portion of a schematic plan view showing a flow of exhaust gases of a first cylinder in an exhaust gas control apparatus according to a first embodiment.

The main flow of the exhaust gas discharged from the first cylinder 10*a* flows along the outer wall of the bent portion 21 of the first exhaust passage 20*a* connected to the first exhaust port 11*a* and flows into the inflow port 31 of the merging portion 30, as indicated by arrows in FIGS. 3A and 3B. The main flow of the exhaust gas flowing into the merging portion 30 becomes a jet flow by the diffusion portion 32 and flows into the merging portion 30. Due to the jet of the exhaust gas, the flow of the exhaust gas stagnating toward the wall of the first exhaust passage 20*a* is separated from the wall. Further, as shown in FIG. 3B, the stationary gas around the inflow port 31 is entrained by the jet of the exhaust gas, and the exhaust gas is diffused, so that the flow rate of the exhaust gas decreases.

Figure 4A:
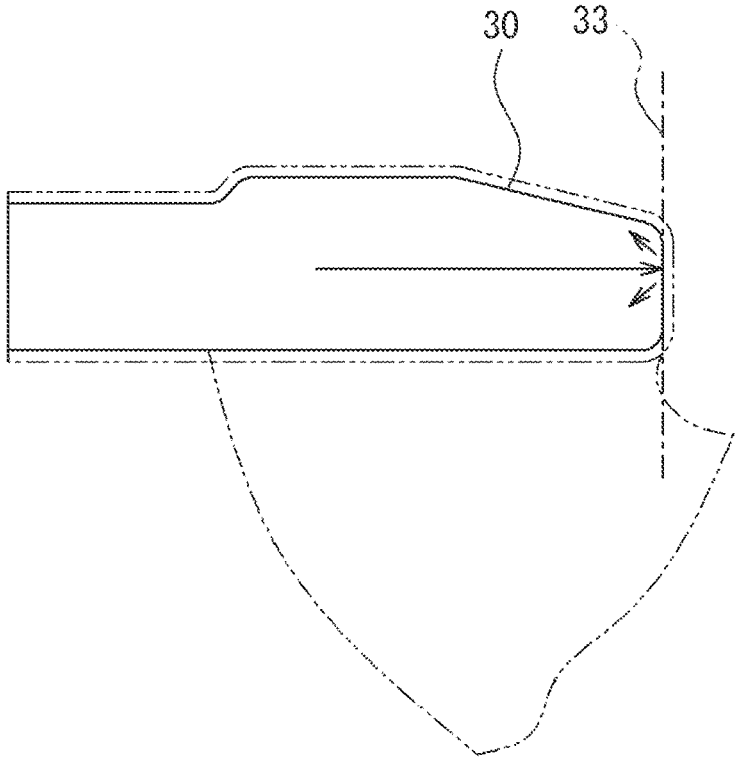
FIG. 4A is a schematic side view illustrating a flow of exhaust gases in an exhaust gas control apparatus according to a first embodiment.

Further, the main flow of the exhaust gas that has flowed linearly into the merging portion 30 collides with the dispersion face 33 that faces the inflow port 31, and the flow is three-dimensionally dispersed with respect to the colliding portion as shown in FIGS. 3A and 4A. This reduces the flow rate of the exhaust gas.

Figure 3C:
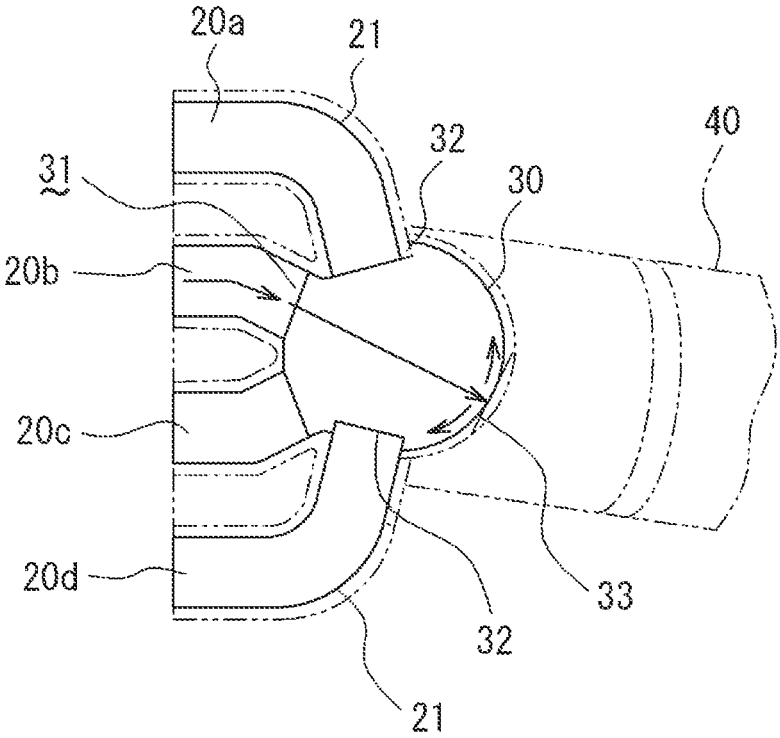
FIG. 3C is a schematic plan view illustrating a flow of exhaust gases of a second cylinder in an exhaust gas control apparatus according to a first embodiment.

The main flow of the exhaust gas discharged from the second cylinder 10*b* flows through the second exhaust passage 20*b* connected to the second exhaust port 11*b* and flows into the inflow port 31 of the merging portion 30, as indicated by an arrow in FIG. 3C. The main flow of the exhaust gas linearly flowing into the merging portion 30 collides with the dispersion face 33 facing the inflow port 31, and is three-dimensionally dispersed with respect to the colliding portion as shown in FIGS. 3C and 4A. This reduces the flow rate of the exhaust gas.

Figure 3D:
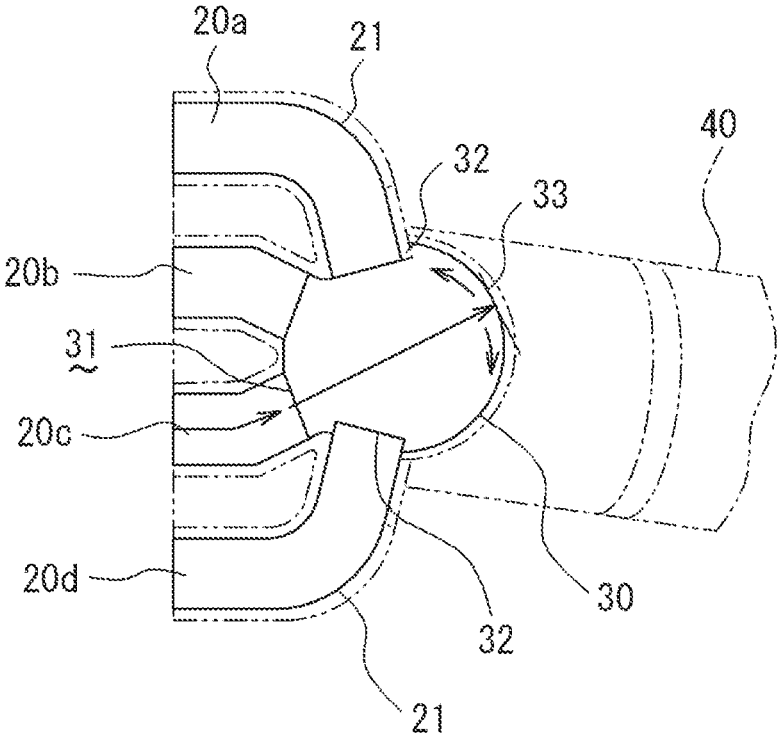
FIG. 3D is a schematic plan view illustrating a flow of exhaust gases of a third cylinder in the exhaust gas control apparatus according to the first embodiment.

The main flow of the exhaust gas discharged from the third cylinder 10*c* flows through the third exhaust passage 20*c* connected to the third exhaust port 11*c* and flows into the inflow port 31 of the merging portion 30, as indicated by an arrow in FIG. 3D. The main flow of the exhaust gas linearly flowing into the merging portion 30 collides with the dispersion face 33 facing the inflow port 31, and is three-dimensionally dispersed with respect to the colliding portion as shown in FIGS. 3D and 4A. This reduces the flow rate of the exhaust gas.

Figure 3E:
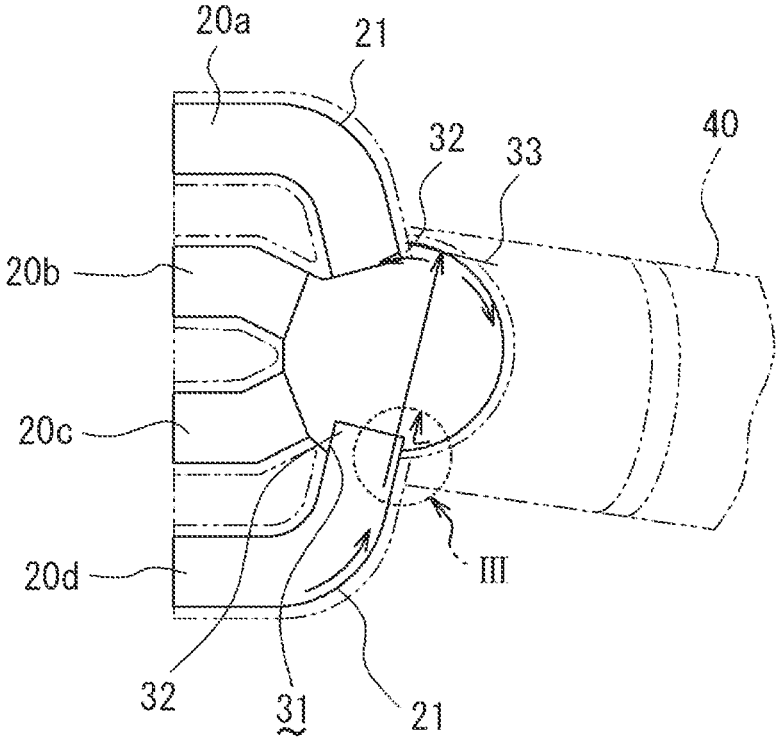
FIG. 3E is a schematic plan view illustrating a flow of exhaust gases of a fourth cylinder in an exhaust gas control apparatus according to a first embodiment.
Figure 3F:
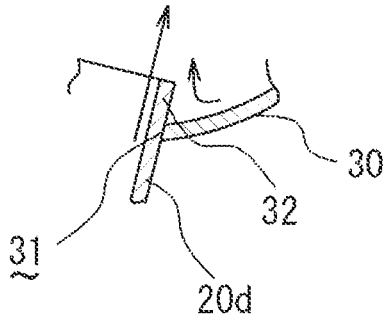
FIG. 3F is an enlarged cross-sectional view of a III portion of a schematic plan view showing a flow of exhaust gases of a fourth cylinder in an exhaust gas control apparatus according to a first embodiment.

The main flow of the exhaust gas discharged from the fourth cylinder 10*d* flows along the outer wall of the bent portion 21 of the fourth exhaust passage 20*d* connected to the fourth exhaust port 11*d* and flows into the inflow port 31 of the merging portion 30, as indicated by arrows in FIGS. 3E and 3F. The main flow of the exhaust gas flowing into the merging portion 30 becomes a jet flow by the diffusion portion 32 and flows into the merging portion 30. Due to the jet of the exhaust gas, the flow of the exhaust gas stagnating toward the wall of the fourth exhaust passage 20*d* is separated from the wall. Further, as shown in FIG. 3F, the stationary gas around the inflow port 31 is entrained by the jet of the exhaust gas, and the exhaust gas is diffused, so that the flow rate of the exhaust gas decreases.

Further, the main flow of the exhaust gas that has flowed linearly into the merging portion 30 collides with the dispersion face 33 that faces the inflow port 31, and is three-dimensionally dispersed with respect to the colliding portion as shown in FIGS. 3E and 4A. This reduces the flow rate of the exhaust gas.

As described above, the main flow of the exhaust gases discharged from the respective cylinders 10*a* to 10*d* flows through the first to fourth exhaust passage 20*a* to 20*d* connected to the respective exhaust ports 11*a* to 11*d* communicating from the respective cylinders 10*a* to 10*d* and flows into the merging portion 30, and the flow velocity decreases due to the diffusion caused by the jet flow of the diffusion portion 32 and the dispersion caused by the collision with the dispersion face 33. Therefore, since the exhaust gas whose flow rate is reduced is sent to the catalytic converter 40 on the downstream side of the merging portion 30, the flow in the catalyst direction can be reduced, and the purification characteristics of the catalyst can be improved.

Figure 4B:
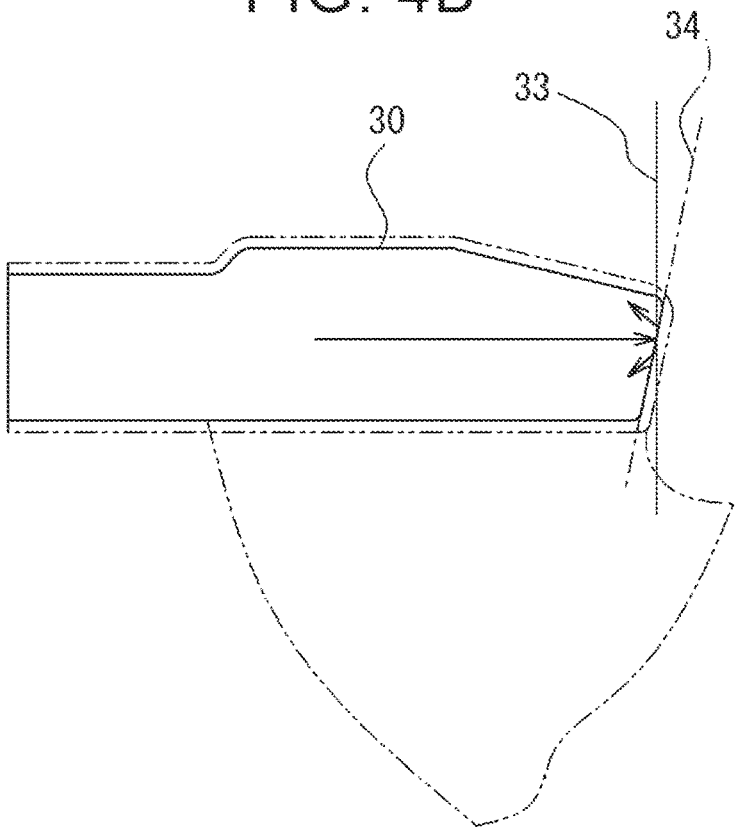
FIG. 4B is a schematic side view illustrating a flow of exhaust gases obtained by deforming a dispersion face in an exhaust gas control apparatus according to a first embodiment.

Incidentally, as shown in FIG. 4B, the dispersion face 33, by forming the upper side of the inclined surface 34 is obtuse with respect to the dispersion face 33 along the vertical direction, it is possible to guide the dispersion direction of the exhaust gas upward, it is possible to further reduce the flow in the catalytic direction.

Second Embodiment

Figure 5:
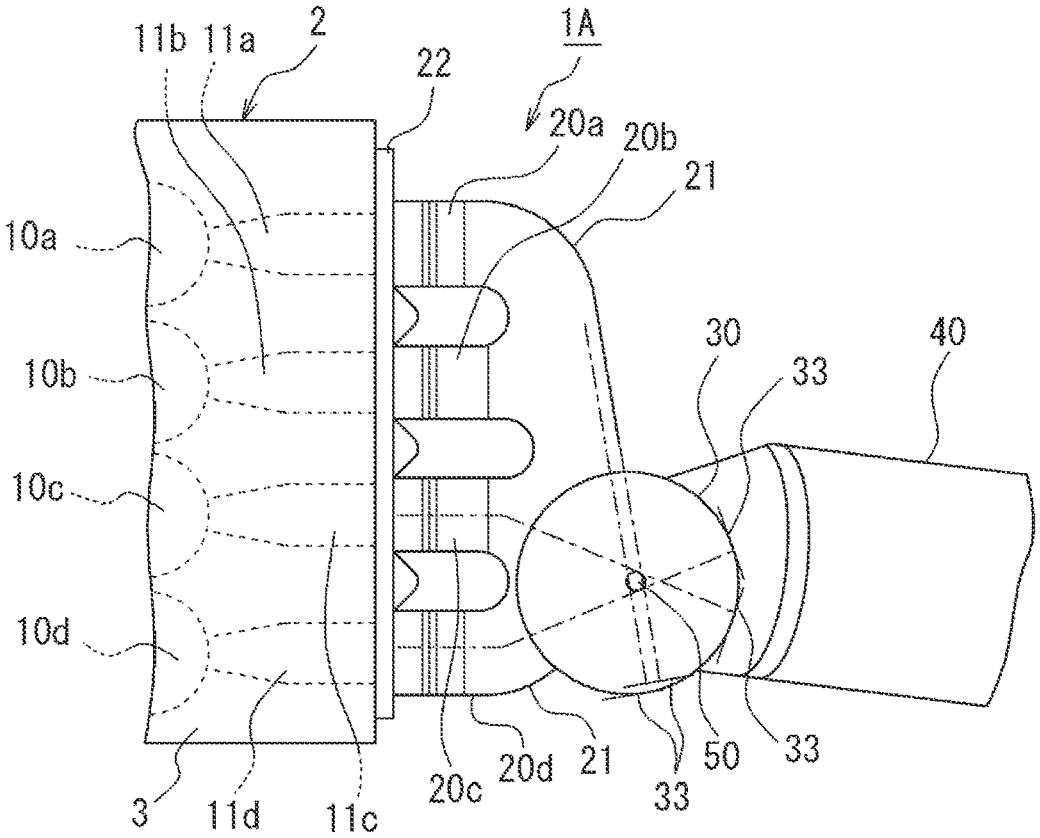
FIG. 5 is a schematic plan view showing a second embodiment of the exhaust gas control apparatus according to the present disclosure.
Figure 6:
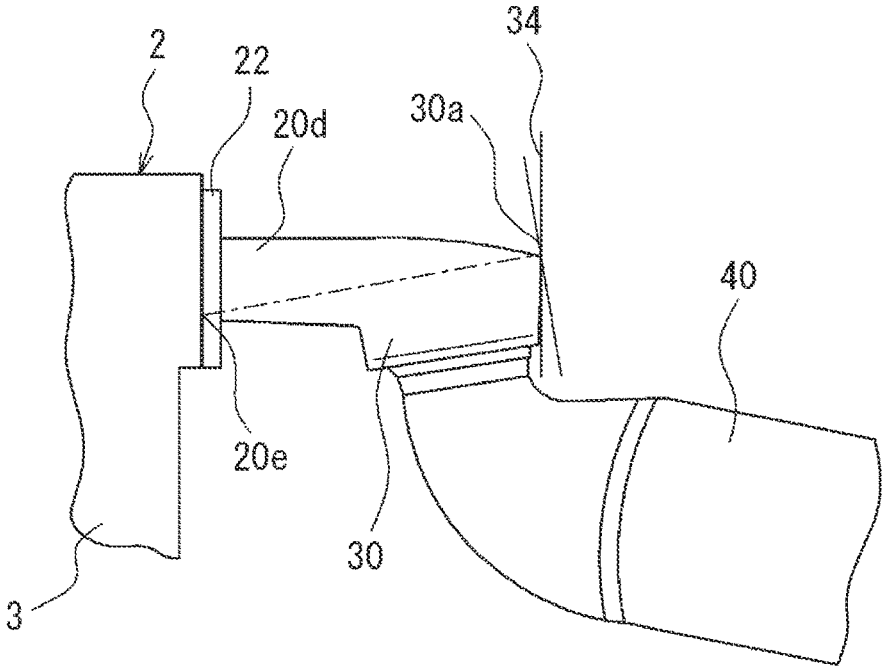
FIG. 6 is a schematic side view of an exhaust gas control apparatus according to a second embodiment.

The exhaust gas control apparatus 1A of the second embodiment is, as shown in FIGS. 5 and 6, when the merging portion 30 is disposed at a position intermediate the third exhaust port 11*c* communicating with the third cylinder 10*c* and the fourth exhaust port 11*d* communicating with the fourth cylinder 10*d* with respect to the cylinder head 3. In the second embodiment, the same parts as those of the first embodiment are denoted by the same reference numerals and will be described.

In the exhaust gas control apparatus 1A of the second embodiment, the first exhaust passage 20*a* communicating with the first cylinder 10*a* is connected such that the distal end of the straight portion extending from the cylinder head 3 to the rear of the engine is inclined toward the merging portion 30 via the bent portion 21. In the second exhaust passage 20*b* communicating with the second cylinder 10*b*, a straight portion extending rearward of the engine 2 from the cylinder head 3 is connected downstream of the bent portion 21 of the first exhaust passage 20*a*. The third exhaust passage 20*c* communicating with the third cylinder 10*c* and the fourth exhaust passage 20*d* communicating with the fourth cylinder 10*d* are bent slightly toward the rear of the engine 2 and connected to the merging portion 30.

The merging portion 30 is provided with an inflow port 31 to which the first exhaust passage 20*a* connecting the second exhaust passage 20*b*, the third exhaust passage 20*c*, and the fourth exhaust passage 20*d* are connected.

In the merging portion 30, a dispersion face 33 is formed on an inner wall of the merging portion 30 opposed to the inflow port 31 connecting the first exhaust port 11*a* so as to three-dimensionally disperse the main flow of the exhaust gases linearly flowing from the inflow port 31 into the merging portion 30. Here, the dispersion face 33 is provided so as to be substantially perpendicular to the axis of the first exhaust port 11*a*. Further, the dispersion face 33 is provided so as to be substantially perpendicular to an axis along the outer wall of the bent portion 21 of the first exhaust port 11*a*.

Further, in the merging portion 30, on the inner wall of the merging portion 30 opposed to the inflow port 31 connecting the third exhaust passage 20*c* and the fourth exhaust passage 20*d*, a dispersion face 33 is formed which three-dimensionally disperses the main flow of the exhaust gases flowing linearly from the inflow port 31 into the merging portion 30. Here, the dispersion face 33 is provided so as to be substantially perpendicular to the third exhaust passage 20*c* and the shaft of the fourth exhaust passage 20*d*. In FIG. 5, the dispersion face 33 is indicated by a straight line for ease of understanding.

An air-fuel ratio sensor 50 for measuring an air-fuel ratio (A/F) of the exhaust gas flowing out of the respective cylinders 10*a* to 10*d* is provided at a portion where the main flow of the exhaust gas flowing into the merging portion 30 from the first exhaust passage 20*a*, the third exhaust passage 20*c*, and the fourth exhaust passage 20*d* in the merging portion 30 intersects with each other. As described above, by providing the air-fuel ratio sensor 50 at a portion where the main flow of the exhaust gas flowing into the merging portion 30 from the first exhaust passage 20*a*, the third exhaust passage 20*c*, and the fourth exhaust passage 20*d* intersects with each other, the flow velocity of the exhaust gas discharged from the respective cylinders 10*a* to 10*d* collides with the air-fuel ratio sensor 50 at a high speed, so that the sensor responsiveness can be ensured. The measurement data detected by the air-fuel ratio sensor 50 is transmitted to a control unit (not shown), and the combustion condition of the cylinder 10*a* to 10*d* is controlled based on the measurement value by the control unit.

Next, in the exhaust gas control apparatus 1A of the second embodiment, the flow of the exhaust gas discharged from the respective cylinders 10*a* to 10*d* will be described referring to FIGS. 7A to 7D.

Figure 7A:
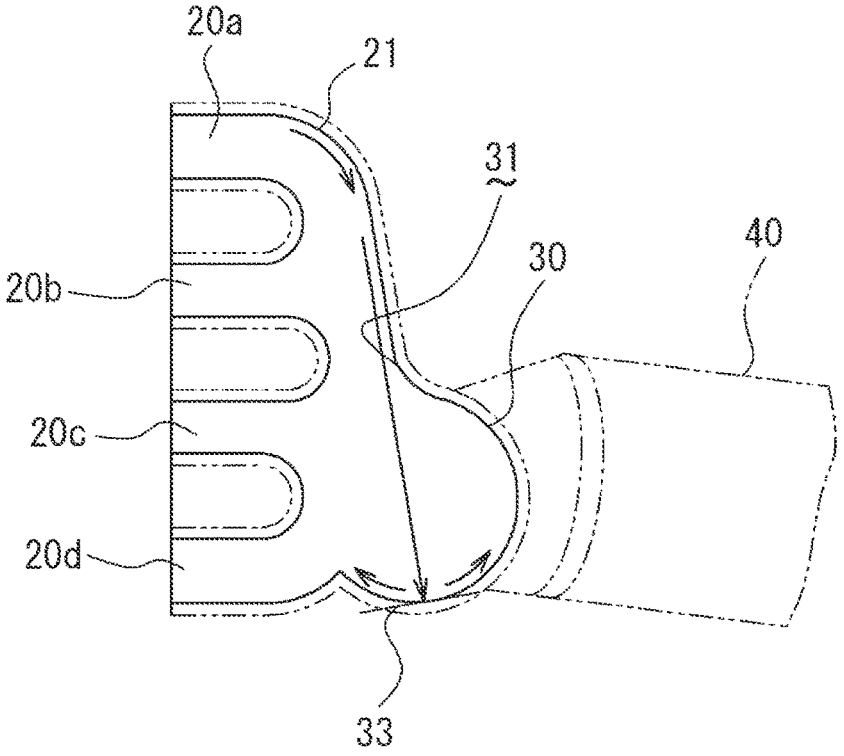
FIG. 7A is a schematic plan view illustrating a flow of exhaust gases of a first cylinder in an exhaust gas control apparatus according to a second embodiment.

As indicated by arrows in FIG. 7A, the main flow of the exhaust gas discharged from the first cylinder 10*a* flows along the outer wall of the bent portion 21 of the first exhaust passage 20*a* connected to the first exhaust port 11*a* and flows into the inflow port 31 of the merging portion 30. The main flow of the exhaust gas that has flowed linearly into the merging portion 30 collides with the dispersion face 33 that faces the inflow port 31, and is three-dimensionally dispersed with respect to the colliding portion as shown in FIG. 7A. This reduces the flow rate of the exhaust gas.

Figure 7B:
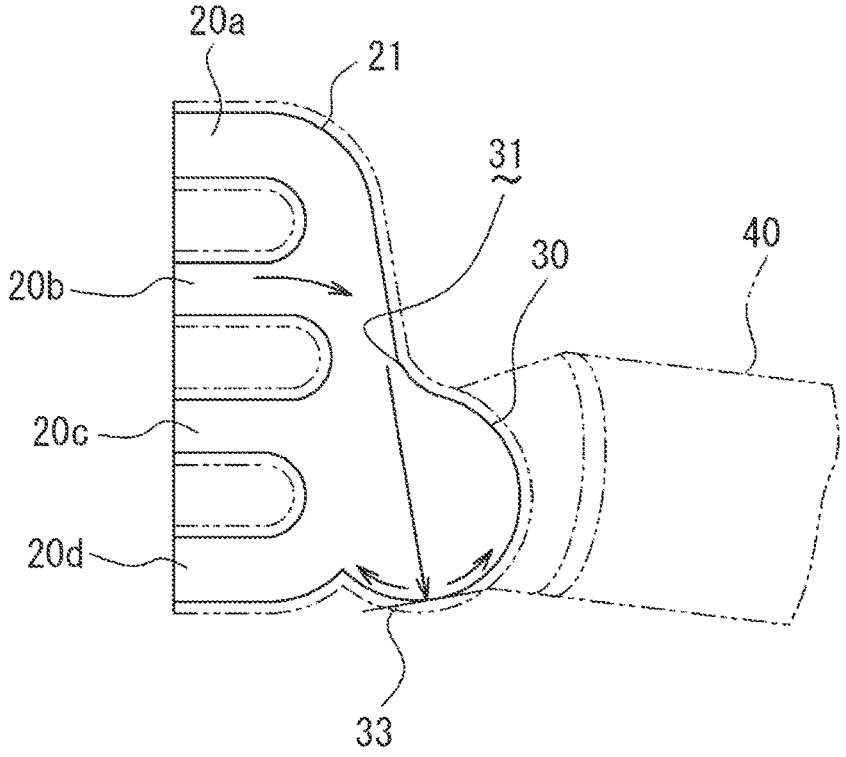
FIG. 7B is a schematic plan view illustrating a flow of exhaust gases of a second cylinder in an exhaust gas control apparatus according to a second embodiment.

As indicated by arrows in FIG. 7B, the main flow of the exhaust gas discharged from the second cylinder 10*b* flows through the second exhaust passage 20*b* connected to the second exhaust port 11*b*, flows downstream of the bent portion 21 of the first exhaust passage 20*a*, flows along the outer wall of the bent portion 21, and flows into the inflow port 31 of the merging portion 30. The main flow of the exhaust gas that has flowed linearly into the merging portion 30 collides with the dispersion face 33 that faces the inflow port 31, and is three-dimensionally dispersed with respect to the colliding portion as shown in FIG. 7B. This reduces the flow rate of the exhaust gas.

Figure 7C:
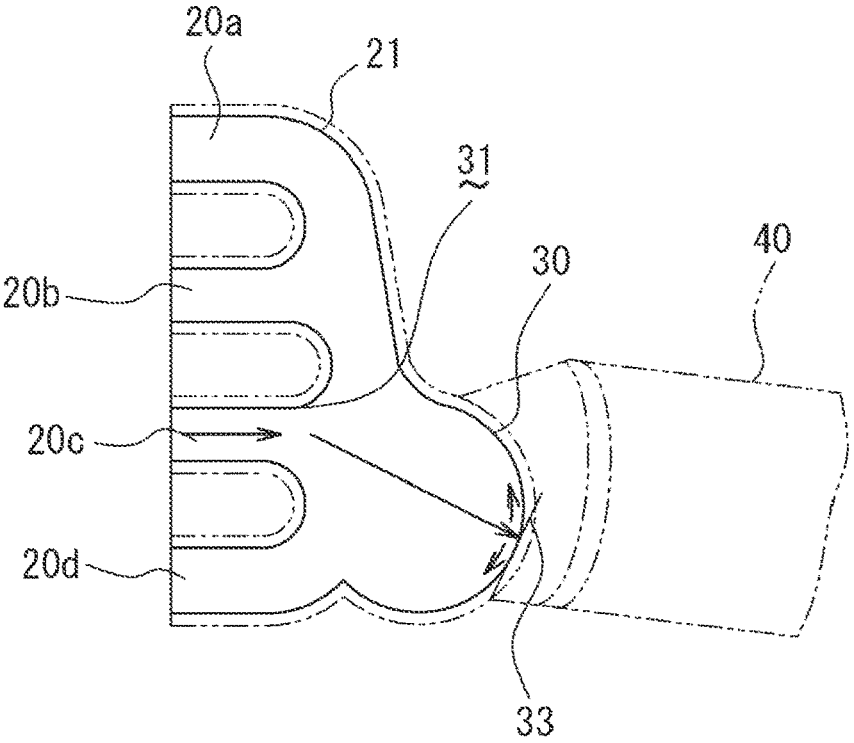
FIG. 7C is a schematic plan view illustrating a flow of exhaust gases of a third cylinder in an exhaust gas control apparatus according to a second embodiment.

The main flow of the exhaust gas discharged from the third cylinder 10*c* flows through the third exhaust passage 20*c* connected to the third exhaust port 11*c* and flows into the inflow port 31 of the merging portion 30, as indicated by an arrow in FIG. 7C. The main flow of the exhaust gas that has flowed linearly into the merging portion 30 collides with the dispersion face 33 that faces the inflow port 31, and is three-dimensionally dispersed with respect to the colliding portion as shown in FIG. 7C. This reduces the flow rate of the exhaust gas.

Figure 7D:
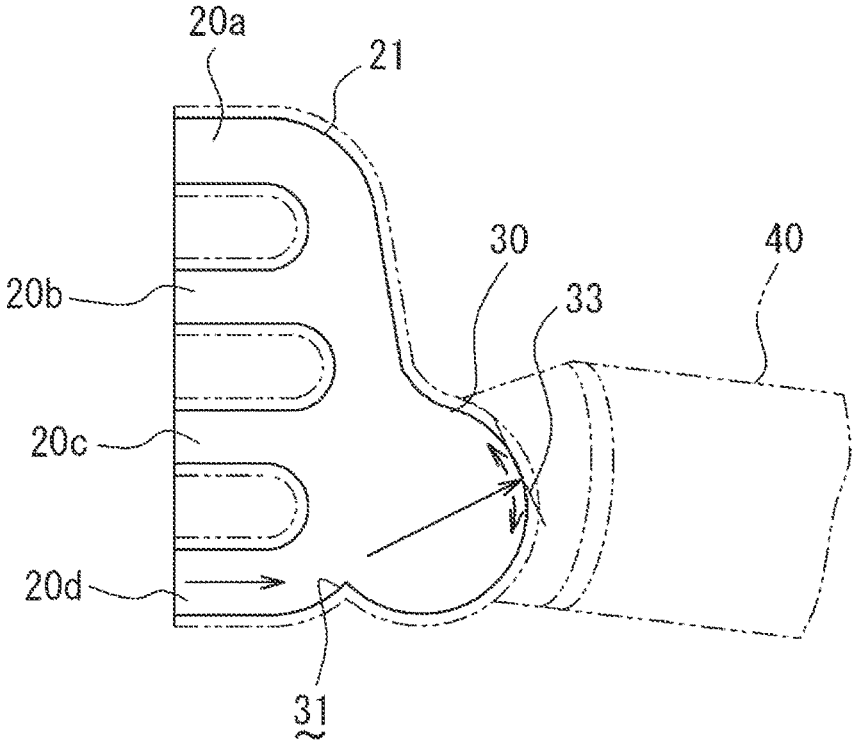
FIG. 7D is a schematic plan view illustrating a flow of exhaust gases of a fourth cylinder in an exhaust gas control apparatus according to a second embodiment.

As indicated by arrows in FIG. 7D, the main flow of the exhaust gas discharged from the fourth cylinder 10*d* flows along the outer wall of the bent portion 21 of the fourth exhaust passage 20*d* connected to the fourth exhaust port 11*d* and flows into the inflow port 31 of the merging portion 30. The main flow of the exhaust gas that has flowed linearly into the merging portion 30 collides with the dispersion face 33 that faces the inflow port 31, and is three-dimensionally dispersed with respect to the colliding portion as shown in FIG. 7D. This reduces the flow rate of the exhaust gas.

As described above, the main flow of the exhaust gases discharged from the respective cylinders 10*a* to 10*d* flows through the first to fourth exhaust passages 20*a* to 20*d* connected to the respective exhaust ports 11*a* to 11*d* communicating with the respective cylinders 10*a* to 10*d*, and flows into the merging portion 30, and the flow velocity decreases due to the dispersion caused by the collision with the dispersion face 33. Therefore, since the exhaust gas whose flow rate is reduced is sent to the catalytic converter 40 on the downstream side of the merging portion 30, the flow in the catalyst direction can be reduced, and the purification characteristics of the catalyst can be improved.

In the third exhaust passage 20*c* and the fourth exhaust passage 20*d* communicating with the third cylinder 10*c* and the fourth cylinder 10*d*, as shown in FIG. 6, by making the angle between the lower surface 20*e* of the inlet part of the third and fourth exhaust passages 20*c*, 20*d* and the wall surface end surface 30*a* of the merging portion 30 substantially at right angles, it is possible to promote the dispersal of the exhaust gases. Further, as shown in FIG. 6, the dispersion face 33 is formed by the inclined surface 34 having an obtuse upper side, it is possible to guide the dispersion direction of the exhaust gas upward, it is possible to further reduce the flow in the catalyst direction.

As described above, the main flow of the exhaust gases discharged from the respective cylinders 10*a* to 10*d* flows through the first to fourth exhaust passages 20*a* to 20*d* connected to the respective exhaust ports 11*a* to 11*d* communicating with the respective cylinders 10*a* to 10*d*, and flows into the merging portion 30, and the flow velocity decreases due to the dispersion caused by the collision with the dispersion face 33. Therefore, since the exhaust gas whose flow rate is reduced is sent to the catalytic converter 40 on the downstream side of the merging portion 30, the flow in the catalyst direction can be reduced, and the purification characteristics of the catalyst can be improved.

Third Embodiment

Figure 8:
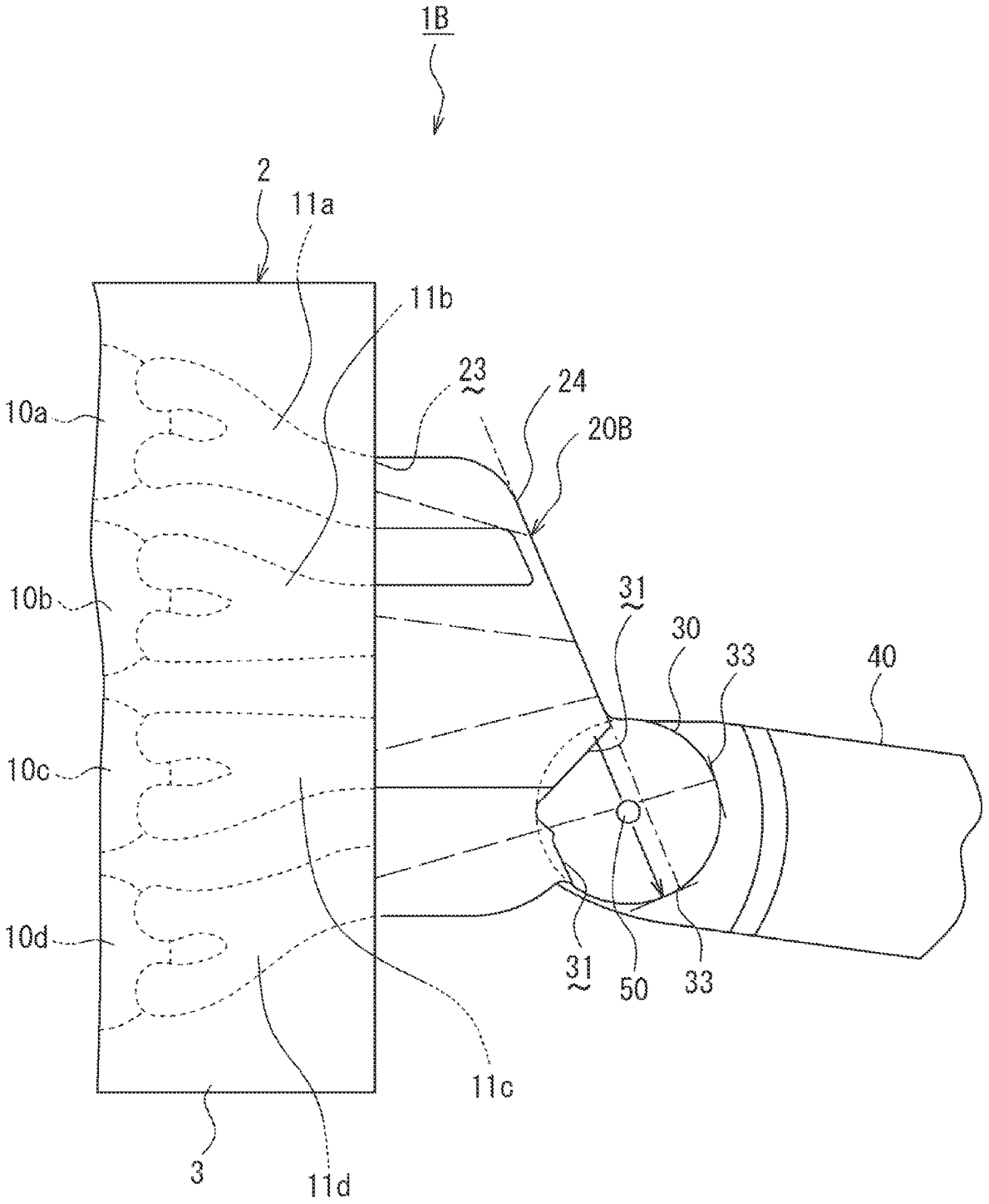
FIG. 8 is a schematic plan view showing a third embodiment of the exhaust gas control apparatus according to the present disclosure.
Figure 9A:
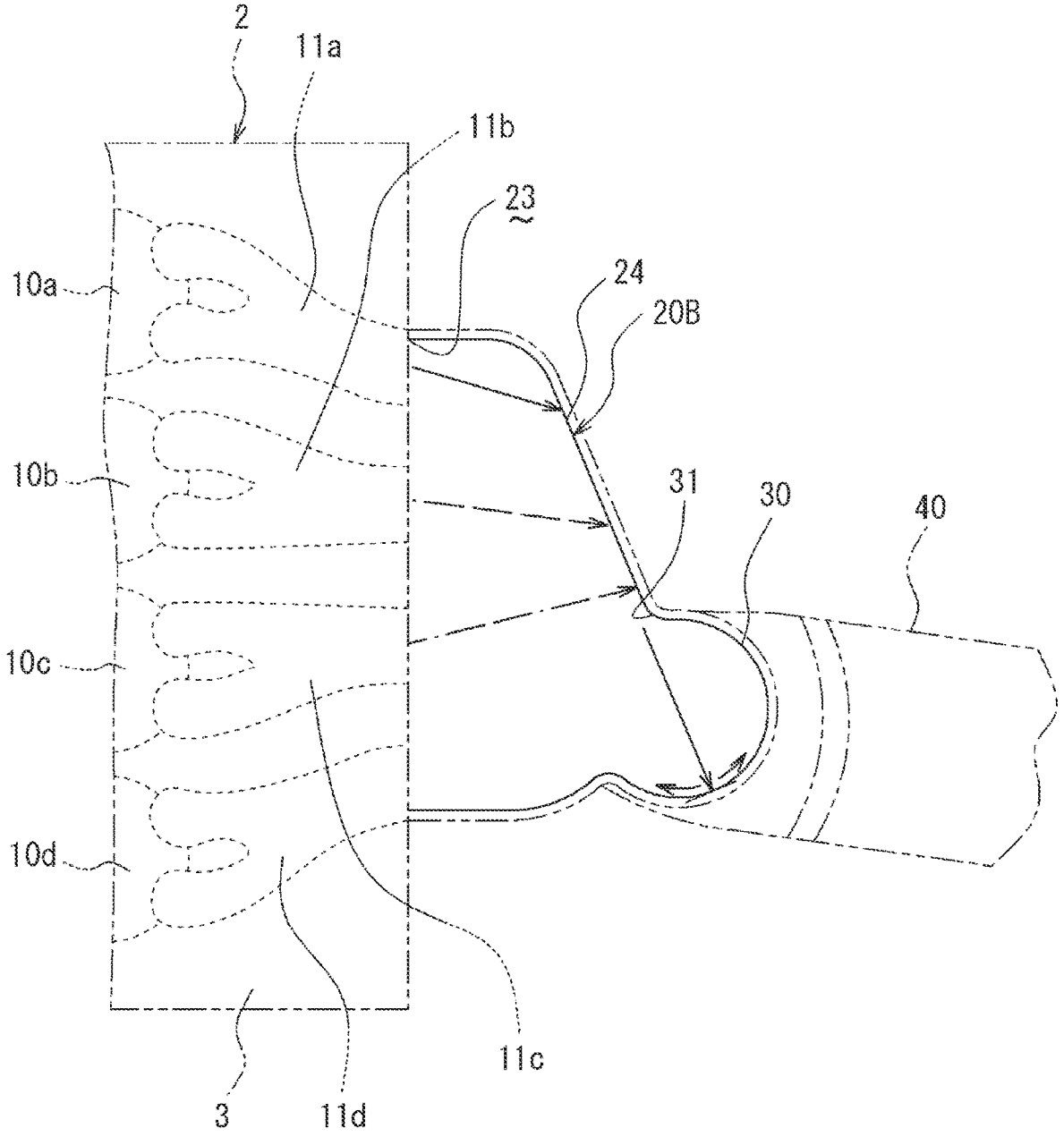
FIG. 9A is a schematic plan view illustrating a flow of exhaust gases of the first to third cylinders in the exhaust gas control apparatus of the third embodiment.
Figure 9B:
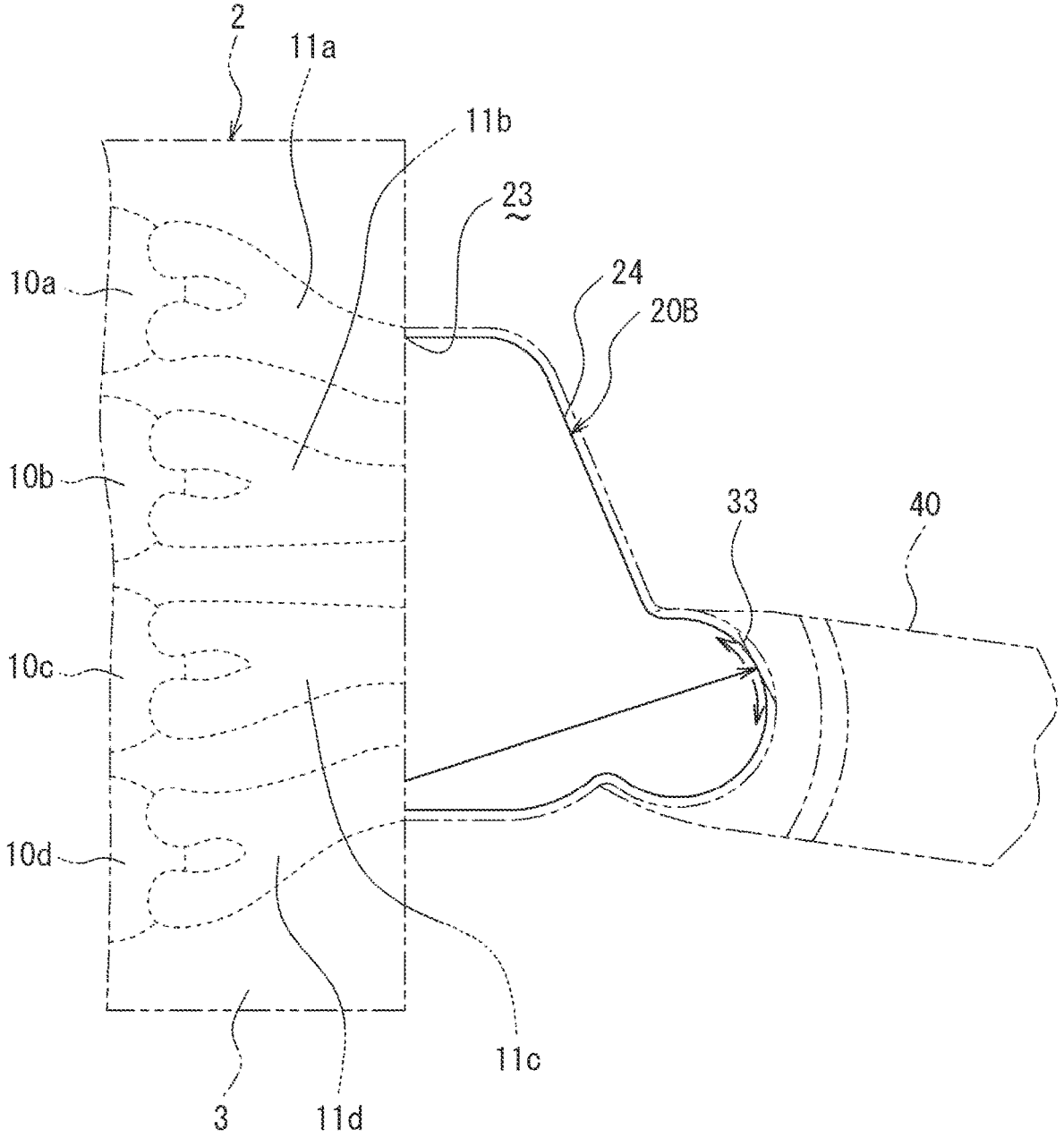
FIG. 9B is a schematic plan view illustrating a flow of exhaust gases of a fourth cylinder in an exhaust gas control apparatus according to the third embodiment.

An exhaust gas control apparatus 1B of the third embodiment is, as shown in FIGS. 8, 9A, and 9B, when the merging portion 30 is arranged at an intermediate position of a third exhaust port 11*c* communicating with the third cylinder 10*c* with respect to the cylinder head 3 and the fourth exhaust port 11*d* communicating with the fourth cylinder 10*d*, and the exhaust passage 20B communicating with the respective exhaust ports 11*a* to 11*d* is formed integrally. In the third embodiment, the same parts as those of the first embodiment are denoted by the same reference numerals and will be described.

In the exhaust gas control apparatus 1B of the third embodiment, the exhaust passage 20B, as shown in FIGS. 9A and 9B, has an opening 23 communicating with 11*d* from the respective exhaust ports 11*a*, the outer wall of the first exhaust port 11*a* is connected to the merging portion 30 with the leading end side of the straight portion extending rearward of the engine 2 from the cylinder head 3 with an enlarged inclination toward the merging portion 30 via the bent portion 21. Further, in the exhaust passage 20B, an outer wall on the fourth exhaust port 11*d* side is gently bent at a distal end side of a straight portion extending rearward of the engine 2 from the cylinder head 3, and is connected to the merging portion 30.

At this time, the exhaust gases discharged from the first cylinder 10*a*, second cylinder 10*b* and the third cylinder 10*c* collide with the inclined wall surface 24 inclined from the bent portion 21 toward the merging portion 30 in the exhaust passage 20B. By forming in this way, the main flow of the exhaust gas discharged from the first cylinder 10*a*, second cylinder 10*b* and the third cylinder 10*c* collides with the inclined wall surface 24 flows into the merging portion 30 along the inclined wall surface 24.

The merging portion 30 is provided with an inflow port 31 that connects the exhaust passage 20B, and a dispersion face 33 that three-dimensionally disperses the main flow of the exhaust gas linearly flowing from the inflow port 31 into the merging portion 30 is formed on the inner wall of the merging portion 30 that faces the inflow port 31. In this case, the dispersion face 33 is provided so as to be substantially orthogonal to the axis along the inclined wall surface 24. Further, the dispersion face 33 is formed with a dispersion face 33 that three-dimensionally disperses the main flow of the exhaust gas flowing linearly from the inflow port 31 into the merging portion 30 on the inner wall of the merging portion 30 that faces the inflow port 31 into which the exhaust gas discharged from the fourth cylinder 10*d* flows.

In the merging portion 30, an air-fuel ratio sensor 50 that measures an air-fuel ratio (A/F) of the exhaust gas flowing out of the respective cylinders 10*a* to 10*d* is provided at a portion where the main flow of the exhaust gas flowing into the merging portion 30 along the inclined wall surface 24 and the main flow of the exhaust gas discharged from the fourth cylinder 10*d* and flowing into the merging portion 30 intersect with each other. As described above, by providing the air-fuel ratio sensor 50 at a portion where the main flow of the exhaust gas flowing into the merging portion 30 along the inclined wall surface 24 and the main flow of the exhaust gas discharged from the fourth cylinder 10*d* and flowing into the merging portion 30 intersect with each other, the flow rate of the exhaust gas discharged from the respective cylinders 10*a* to 10*d* collides with the air-fuel ratio sensor 50 at a high speed, so that the sensor responsiveness can be secured. The measurement data detected by the air-fuel ratio sensor 50 is transmitted to a control unit (not shown), and the combustion condition of the cylinder 10*a* to 10*d* is controlled based on the measurement value by the control unit.

Next, in the exhaust gas control apparatus 1B of the third embodiment, the flow of the exhaust gas discharged from the respective cylinders 10*a* to 10*d* will be described referring to FIGS. 9A and 9B.

The main flow of the exhaust gas discharged from the first cylinder 10*a* collides with the inclined wall surface 24 of the exhaust passage 20B as indicated by a solid arrow in FIG. 9A, and then flows along the inclined wall surface 24 and flows into the inflow port 31 of the merging portion 30. When the flow along the inclined wall surface 24 flows into the merging portion 30, the flow becomes a jet for rapid expansion, and the flow of the exhaust gas stagnating toward the outer wall of the exhaust passage 20B is separated from the wall, and the surrounding stationary gas is entrained and diffused. Then, the main flow of the exhaust gas that has flowed linearly into the merging portion 30 collides with the dispersion face 33 that faces the inflow port 31, and is three-dimensionally dispersed with respect to the colliding portion as shown in FIG. 9A. This reduces the flow rate of the exhaust gas.

The main flow of the exhaust gas discharged from the second cylinder 10*b* collides with the inclined wall surface 24 of the exhaust passage 20B as indicated by a broken line arrow in FIG. 9A, and then flows along the inclined wall surface 24 and flows into the inflow port 31 of the merging portion 30. When the flow along the inclined wall surface 24 flows into the merging portion 30, the flow becomes a jet for rapid expansion, and the flow of the exhaust gas stagnating toward the outer wall of the exhaust passage 20B is separated from the wall, and the surrounding stationary gas is entrained and diffused. Then, the main flow of the exhaust gas that has flowed linearly into the merging portion 30 collides with the dispersion face 33 that faces the inflow port 31, and is three-dimensionally dispersed with respect to the colliding portion as shown in FIG. 9A. This reduces the flow rate of the exhaust gas.

The main flow of the exhaust gas discharged from the third cylinder 10*c* collides with the inclined wall surface 24 of the exhaust passage 20B as indicated by a dashed-dotted arrow in 9A of the drawing, and then flows along the inclined wall surface 24 and flows into the inflow port 31 of the merging portion 30. When the flow along the inclined wall surface 24 flows into the merging portion 30, the flow becomes a jet for rapid expansion, and the flow of the exhaust gas stagnating toward the outer wall of the exhaust passage 20B is separated from the wall, and the surrounding stationary gas is entrained and diffused. Then, the main flow of the exhaust gas that has flowed linearly into the merging portion 30 collides with the dispersion face 33 that faces the inflow port 31, and is three-dimensionally dispersed with respect to the colliding portion as shown in FIG. 9A. This reduces the flow rate of the exhaust gas.

The main flow of the exhaust gas discharged from the fourth cylinder 10*d* flows into the inflow port 31 of the exhaust passage 20B connected to the fourth exhaust port 11*d* as indicated by an arrow in FIG. 9B. The main flow of the exhaust gas that has flowed linearly into the merging portion 30 collides with the dispersion face 33 that faces the inflow port 31, and is three-dimensionally dispersed with respect to the colliding portion as shown in FIG. 9B. This reduces the flow rate of the exhaust gas.

As described above, the main flow of the exhaust gas discharged from the first to third cylinders 10*a* to 10*c* collides with the inclined wall surface 24 of the exhaust passage 20B, then flows along the inclined wall surface 24 and flows into the inflow port 31 of the merging portion 30, collides with the dispersion face 33 opposed to the inflow port 31, and is three-dimensionally dispersed with respect to the colliding portion. The dispersion caused by the collision with the dispersion face 33 lowers the flow velocity. Further, the main flow of the exhaust gas discharged from the fourth cylinder 10*d* flows into the inflow port 31 of the merging portion 30 to become a jet, and the flow of the exhaust gas stagnating on the outer wall of the exhaust passage 20B is separated from the wall, and the surrounding stationary gas is entrained and diffused. Further, the main flow of the exhaust gas that has flowed into the merging portion 30 collides with the dispersion face 33 that faces the inflow port 31, and is three-dimensionally dispersed with respect to the colliding portion. Therefore, since the exhaust gas whose flow rate is reduced is sent to the catalytic converter 40 on the downstream side of the merging portion 30, the flow in the catalyst direction can be reduced, and the purification characteristics of the catalyst can be improved.

Fourth Embodiment

Figure 10:
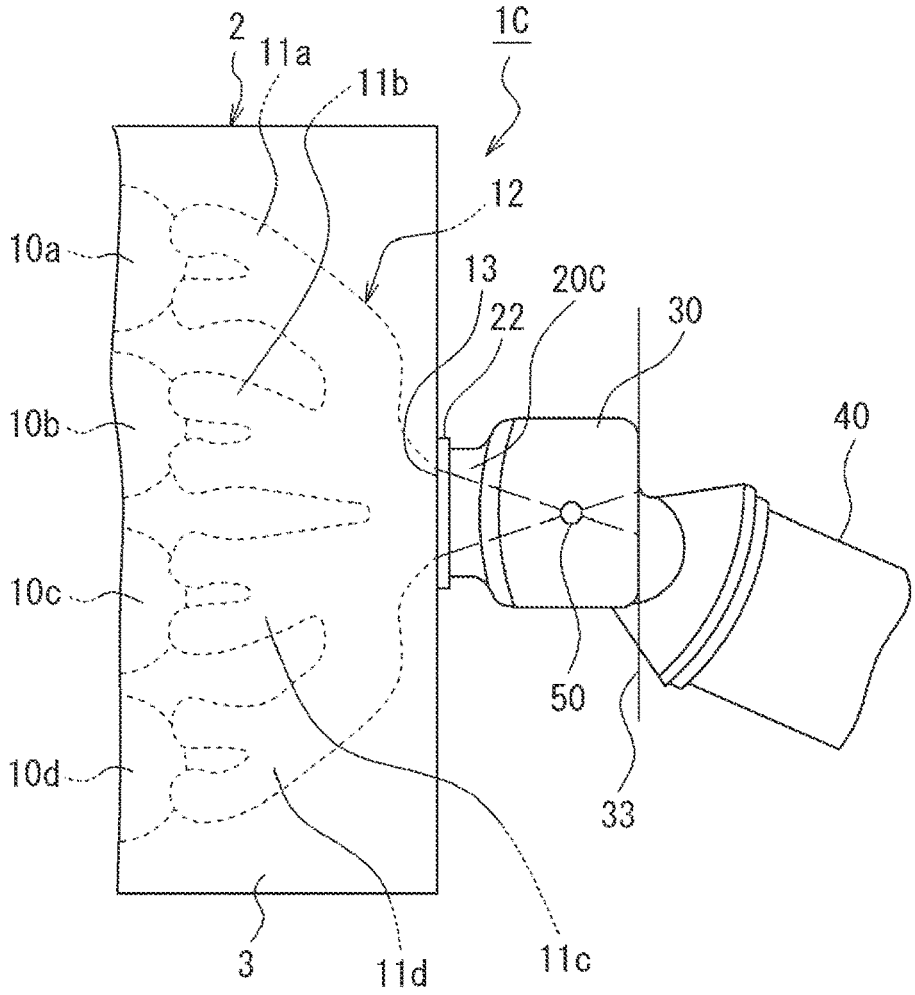
FIG. 10 is a schematic plan view showing a fourth embodiment of the exhaust gas control apparatus according to the present disclosure.
Figure 11:
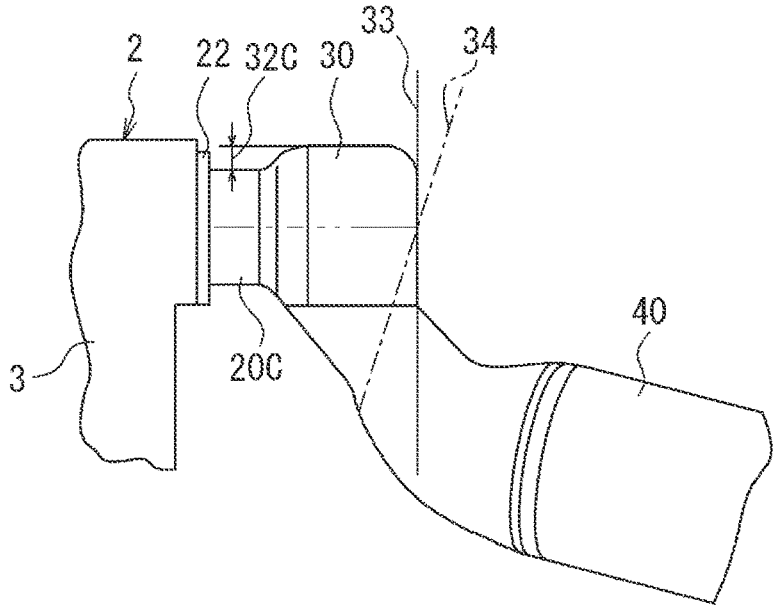
FIG. 11 is a schematic side view of an exhaust gas control apparatus according to a fourth embodiment.

As shown in FIGS. 10 and 11, the exhaust gas control apparatus 1C of the fourth embodiment is when the exhaust passage 20C communicating with the collective exhaust port 12 in which 11*d* are collected from the exhaust port 11*a* communicating with 10*d* from the respective cylinders 10*a* is connected to the merging portion 30. Here, the discharge port 13 of the collective exhaust port 12 is provided at a position intermediate between the second exhaust port 11*b* and the third exhaust port 11*c*. In the fourth embodiment, the same parts as those of the first embodiment are denoted by the same reference numerals and will be described.

In the exhaust gas control apparatus 1C of the fourth embodiment, the merging portion 30 is disposed at an intermediate position between the second exhaust port 11*b* communicating with the second cylinder 10*b* and the third exhaust port 11*c* communicating with the third cylinder 10*c* with respect to the cylinder head 3 via the exhaust passage 20C communicating with the discharge port 13 of the collective exhaust port 12.

The merging portion 30 is provided with an inflow port 31 that connects the exhaust passage 20C, and the connecting portion with the exhaust passage 20C is provided with a diffusion portion 32C that promotes the jet flow of the main flow of the exhaust gas flowing into the merging portion 30. Here, the diffusion portion 32C is formed by a step between the exhaust passage 20C and the connecting portion of the merging portion 30.

Further, the merging portion 30, the inner wall of the merging portion 30 facing the inflow port 31, the main flow of the exhaust gas flowing linearly into the merging portion 30 from the inflow port 31 along the wall surface 25 of the exhaust passage 20C is three-dimensionally dispersed dispersion face 33 is formed.

In the merging portion 30, an air-fuel ratio sensor 50 for measuring an air-fuel ratio (A/F) of the exhaust gas flowing out of the respective cylinders 10*a* to 10*d* is provided at a portion where the main flow of the exhaust gas discharged from the respective cylinders 10*a* to 10*d* and flowing into the merging portion 30 along the wall surface 25 of the exhaust passage 20C intersects with each other as in the first to third embodiments.

Next, in the exhaust gas control apparatus 1C of the fourth embodiment, the flow of the exhaust gas discharged from the respective cylinders 10*a* to 10*d* will be described referring to FIGS. 12 and 13. Since the first cylinder 10*a*, fourth cylinder 10*d* and the second cylinder 10*b*, third cylinder 10*c* are symmetrical, the first cylinder 10*a* and the second cylinder 10*b* will be described here.

Figure 12:
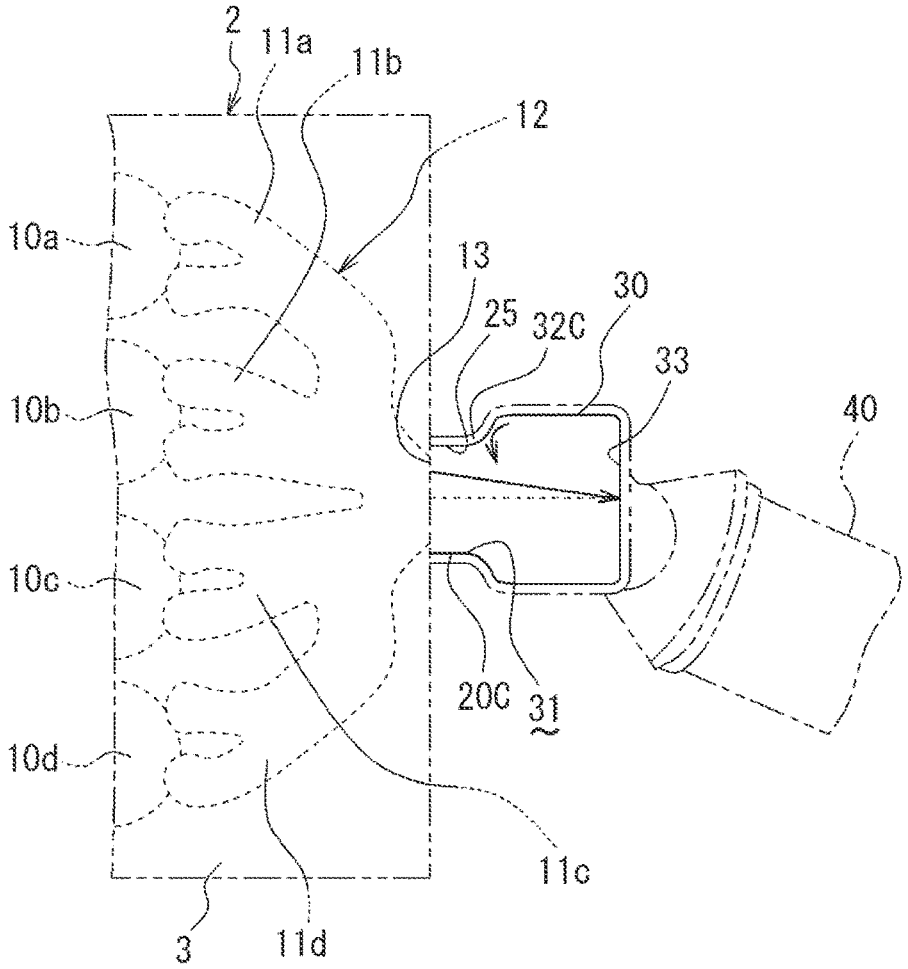
FIG. 12 is a schematic plan view showing a flow of exhaust gas in the exhaust gas control apparatus according to the fourth embodiment.
Figure 13:
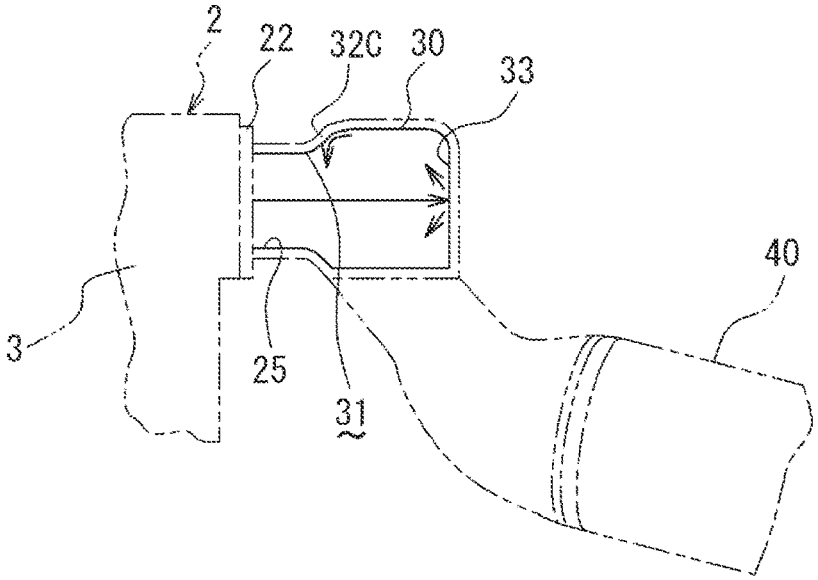
FIG. 13 is a schematic side view showing a flow of exhaust gas in the exhaust gas control apparatus of the fourth embodiment.

As indicated by arrows in FIG. 12, the exhaust gas discharged from the first cylinder 10*a* is largely bent and flows into the merging portion 30 along the wall surface 25 of the exhaust passage 20C from the discharge port 13 of the collective exhaust port 12. The main flow of the exhaust gas flowing into the merging portion 30 becomes a jet by the diffusion portion 32C formed by the step between the exhaust passage 20C and the connecting portion of the merging portion 30, and separates the flow of the exhaust gas stagnating toward the wall of the exhaust passage 20C from the wall, and diffuses by entraining the surrounding stationary gas. Then, the main flow of the exhaust gas linearly flowing into the merging portion 30 collides with the dispersion face 33 opposed to the inflow port 31, and is three-dimensionally dispersed with respect to the collision portion as shown in FIG. 13. This reduces the flow rate of the exhaust gas.

The exhaust gas discharged from the second cylinder 10*b* flows into the merging portion 30 substantially linearly along the wall surface 25 of the exhaust passage 20C through the discharge port 13 of the collective exhaust port 12. The main flow of the exhaust gas flowing into the merging portion 30 becomes a jet by the diffusion portion 32C formed by the step between the exhaust passage 20C and the connecting portion of the merging portion 30, and separates the flow of the exhaust gas stagnating toward the wall of the exhaust passage 20C from the wall, and diffuses by entraining the surrounding stationary gas. Then, the main flow of the exhaust gas linearly flowing into the merging portion 30 collides with the dispersion face 33 opposed to the inflow port 31, and is three-dimensionally dispersed with respect to the collision portion as shown in FIG. 13. This reduces the flow rate of the exhaust gas.

As described above, the main flow of the exhaust gas discharged from the first to fourth cylinders 10*a* to 10*d* flows along the wall surface 25 of the exhaust passage 20C and flows into the inflow port 31 of the merging portion 30 to become a jet flow, and the flow of the exhaust gas stagnating on the outer wall of the exhaust passage 20C is separated from the wall, and the surrounding stationary gas is entrained and diffused. Further, the main flow of the exhaust gas that has flowed into the merging portion 30 collides with the dispersion face 33 that faces the inflow port 31, and is three-dimensionally dispersed with respect to the colliding portion. Therefore, since the exhaust gas whose flow rate is reduced is sent to the catalytic converter 40 on the downstream side of the merging portion 30, the flow in the catalyst direction can be reduced, and the purification characteristics of the catalyst can be improved.

In the exhaust gas control apparatus 1C of the fourth embodiment, as shown in FIG. 11, the dispersion face 33 is formed by the inclined surface 34 whose upper side is obtuse, so that the dispersion direction of the exhaust gas can be guided upward, so that the flow in the catalytic direction can be further reduced.

Figure 14:
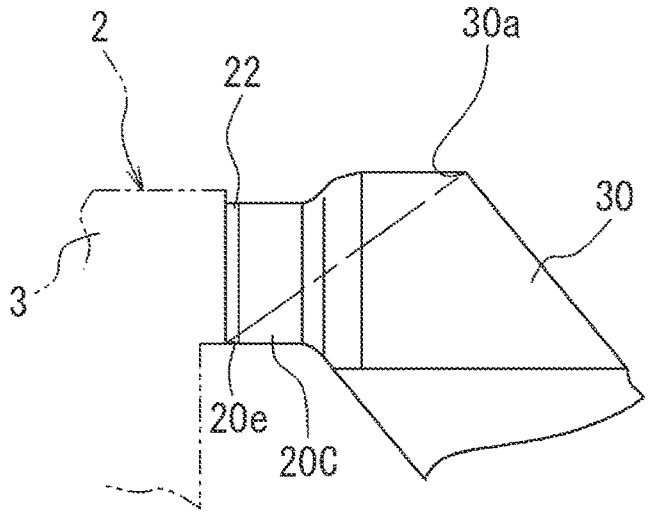
FIG. 14 is a schematic side view showing a modification of the exhaust gas control apparatus according to the fourth embodiment.

Further, in the exhaust gas control apparatus 1C of the fourth embodiment, as shown in FIG. 14, by making the angle between the lower surface 20*e* of the inlet part of the exhaust passage 20C and the wall surface end surface 30*a* of the merging portion 30 substantially at right angles, it is possible to promote the dispersal of the exhaust gas.

Fifth Embodiment

Figure 15:
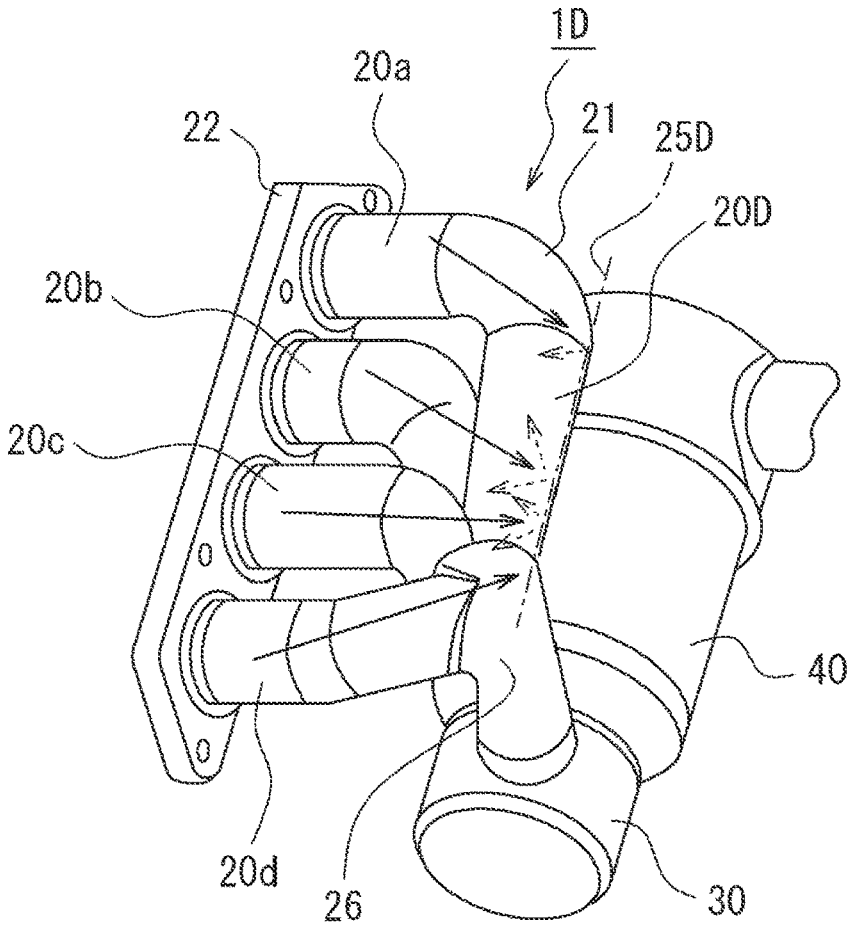
FIG. 15 is a schematic perspective view showing a fifth embodiment of the exhaust gas control apparatus according to the present disclosure.
Figure 16:
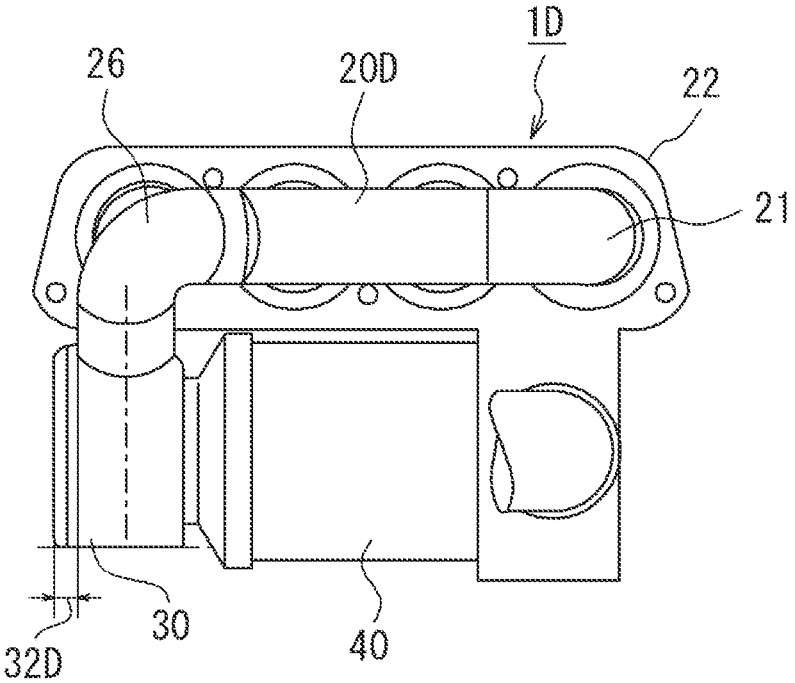
FIG. 16 is a schematic side view of an exhaust gas control apparatus according to a fifth embodiment.
Figure 17:
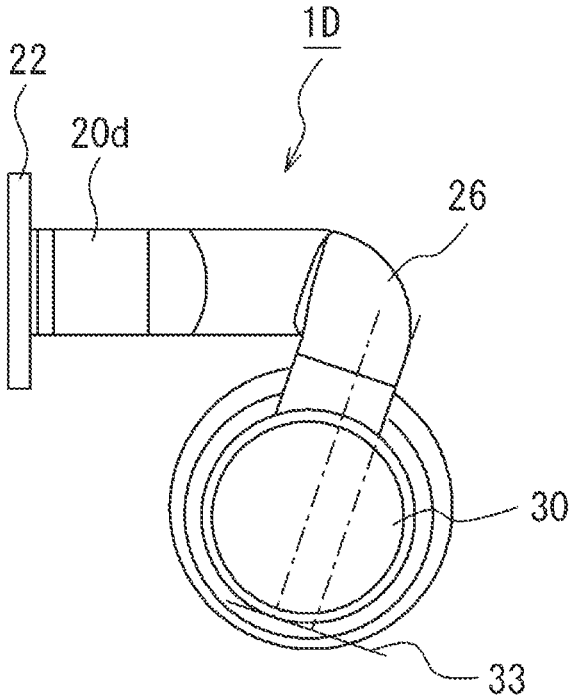
FIG. 17 is a schematic front view of an exhaust gas control apparatus according to a fifth embodiment.

The exhaust gas control apparatus 1D of the fifth embodiment has, as shown in FIGS. 15 to 17, a manifold exhaust passage 20D in which a wall 25D is provided on an extension line of each central axis of 20*d* from each exhaust passage 20*a* communicating with 10*d* from each cylinder 10*a*, and the manifold exhaust passage 20D is connected to the merging portion 30. In the fifth embodiment, the same parts as those of the first embodiment are denoted by the same reference numerals and will be described.

The wall 25D provided in the manifold exhaust passage 20D is formed perpendicularly to the central axis of each of the respective exhaust passages 20*a* to 20*d* or the extension line of the wall surface.

In the exhaust gas control apparatus 1D of the fifth embodiment, the merging portion 30 is disposed on the fourth cylinder 10*d* side with respect to the cylinder head 3, and is connected to the merging portion 30 via an elbow portion 26 in which a downstream-side end of the manifold exhaust passage 20D extending through the bent portion 21 in the first exhaust passage 20*a* is bent. The downstream-side ends of the second to fourth exhaust passages 20*b* to 20*d* are connected to the manifold exhaust passage 20D.

The merging portion 30 connected to the downstream-side of the manifold exhaust passage 20D is provided with a diffusion portion 32D that promotes the jet flow of the main flow of the exhaust gases flowing into the merging portion 30. Here, the diffusion portion 32D is formed by a step in a connecting portion between the manifold exhaust passage 20D (specifically, the elbow portion 26) and the merging portion 30. The diffusion portion may be formed by projecting the elbow portion 26 into the merging portion 30.

Further, the merging portion 30, the inner wall of the merging portion 30 facing the inflow port 31 connecting the manifold exhaust passage 20D, the main flow of the exhaust gas flowing linearly into the merging portion 30 from the inflow port 31 is three-dimensionally dispersion face 33 is formed. Here, the dispersion face 33 is provided so as to be substantially perpendicular to the axis of the manifold exhaust passage 20D. Further, the dispersion face 33 is provided so as to be substantially perpendicular to the axial 26*a* of the elbow portion 26 of the manifold exhaust passage 20D. The dispersion face 33 may be formed by an inclined surface having an obtuse upper side perpendicular to the axis of the manifold exhaust passage 20D.

Figure 18:
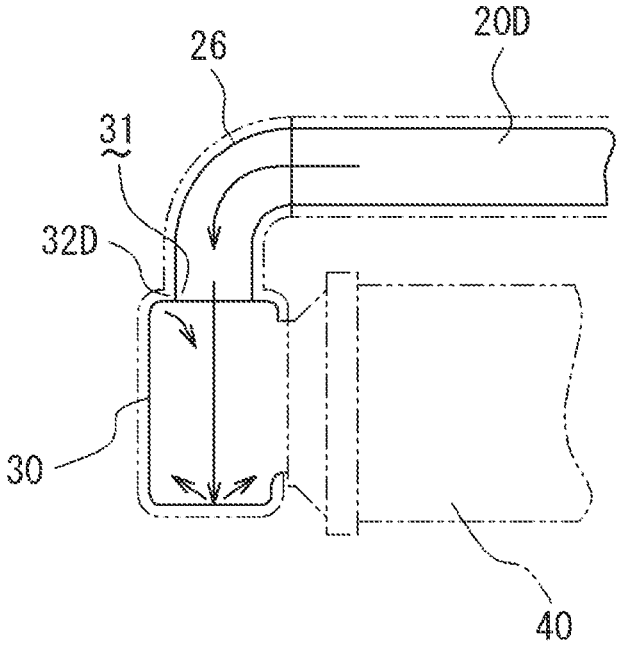
FIG. 18 is a schematic side view showing the flow of exhaust gases in the exhaust gas control apparatus of the fifth embodiment.
Figure 19:
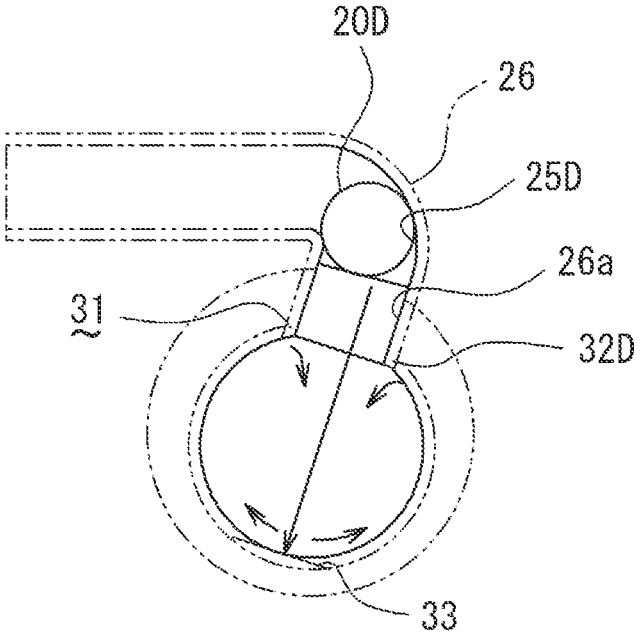
FIG. 19 is a schematic front view illustrating a flow of exhaust gas in the exhaust gas control apparatus of the fifth embodiment.

Next, in the exhaust gas control apparatus 1D of the fifth embodiment, the flow of the exhaust gas discharged from the respective cylinders 10*a* to 10*d* will be described referring to FIGS. 15, 18, and 19.

Exhaust gases discharged from the respective cylinders 10*a* to 10*d* flow through the respective cylinders 10*a* to 10*d* as indicated by arrows in FIG. 15, collide with and are dispersed in the wall 25D of the manifold exhaust passage 20D, flow through the manifold exhaust passage 20D along the wall 25D, and flow into the merging portion 30. The main flow of the exhaust gas flowing into the merging portion 30 becomes a jet by the diffusion portion 32D formed by the step of the connecting portion of the merging portion 30 and the manifold exhaust passage 20D, and separates the flow of the exhaust gas stagnating toward the wall of the manifold exhaust passage 20D from the wall, and diffuses by entraining the surrounding stationary gas. Then, the main flow of the exhaust gas linearly flowing into the merging portion 30 collides with the dispersion face 33 facing the inflow port 31, and is three-dimensionally dispersed with respect to the colliding portion as shown in FIGS. 18 and 19. This reduces the flow rate of the exhaust gas.

As described above, the exhaust gas discharged from the first to fourth cylinders 10*a* to 10*d* flows through the respective cylinders 10*a* to 10*d* and collides with 20D wall-wall 25D of the manifold exhaust passage to be dispersed, thereby suppressing variations in the distribution of the exhaust gas discharged from the respective cylinders 10*a* to 10*d*. Then, the exhaust gas whose distribution variation is suppressed flows along the wall 25D of the manifold exhaust passage 20D, flows into the inflow port 31 of the merging portion 30, becomes a jet, and separates the flow of the exhaust gas stagnant on the wall 25D of the manifold exhaust passage 20D from the wall 25D, and diffuses by entraining the surrounding stationary gas. Further, the main flow of the exhaust gas flowing into the merging portion 30 collides with the dispersion face 33 opposed to the inflow port 31, and is three-dimensionally dispersed with respect to the colliding portion. Therefore, since the exhaust gas whose flow rate is reduced is sent to the catalytic converter 40 on the downstream side of the merging portion 30, the flow in the catalyst direction can be reduced, and the purification characteristics of the catalyst can be improved.

In the exhaust gas control apparatus 1D of the fifth embodiment, the dispersion face 33 of the merging portion 30 is formed by an inclined surface (not shown) whose upper side is obtuse, so that the dispersion direction of the exhaust gas can be guided upward, so that the flow in the catalytic direction can be further reduced.

In the above embodiment, the engine has been described in the case of four cylinders, but the present disclosure is not limited thereto, and the engine may be a plurality of cylinders other than four cylinders.

What is claimed is:

1. An exhaust gas control apparatus comprising:

a catalytic converter;

a merging portion that connects the catalytic converter to an internal combustion engine; and a diffusion protrusion provided in the merging portion, wherein the internal combustion engine includes a plurality of cylinders and a plurality of exhaust passages respectively communicating with the cylinders, the merging portion has a cylindrical shape and is connected to a downstream side of each of the exhaust passages, the catalytic converter is connected to a downstream side of the merging portion, and the diffusion protrusion is configured to promote a jet flow of a main flow of exhaust gas flowing into the merging portion.

2. The exhaust gas control apparatus according to claim 1, wherein the diffusion protrusion is a downstream end portion of each of the exhaust passages that protrudes into the merging portion.

3. The exhaust gas control apparatus according to claim 1, further comprising an air-fuel ratio sensor merging portion at a section where main flows of the exhaust gas from the exhaust passages converge.

4. An exhaust gas control apparatus comprising:

a catalytic converter; and a merging portion that connects the catalytic converter and an internal combustion engine and that is provided with a dispersion surface on an inner wall of the merging portion, wherein the internal combustion engine including a plurality of cylinders and a plurality of exhaust passages respectively communicating with the cylinders, the merging portion has a cylindrical shape and is connected to a downstream side portion of each of the exhaust passages, the catalytic converter is connected to a downstream side of the merging portion, and the dispersion surface faces an outflow opening of exhaust gas in the downstream side portion and that three-dimensionally disperses a main flow of exhaust gas linearly flowed into the merging portion from the outflow opening.

5. The exhaust gas control apparatus according to claim 4, wherein at least one of the exhaust passages is connected to the merging portion via a bent portion, and the dispersion surface provided in the merging portion so as to be orthogonal to an axis along an outer wall of the bent portion.

6. The exhaust gas control apparatus according to claim 5, further comprising a diffusion protrusion provided in the merging portion, the diffusion protrusion being configured to promote a jet flow of the main flow of the exhaust gas flowing into the merging portion.

7. The exhaust gas control apparatus according to claim 6, wherein the diffusion protrusion is a downstream end portion of each of the exhaust passages that protrudes into the merging portion.

8. The exhaust gas control apparatus according to claim 4, wherein:

one of the exhaust passages is a manifold exhaust passage connected with the other exhaust passages, the manifold exhaust passage having a wall on an extension line of the center axis of each of the other exhaust passages; and the manifold exhaust passage is connected to the merging portion.

9. The exhaust gas control apparatus according to claim 8, wherein a diffusion protrusion is provided in the merging portion connected to a downstream side portion of the manifold exhaust passage, the diffusion protrusion being configured to promote a jet flow of the main flow of the exhaust gas flowing into the merging portion.

10. The exhaust gas control apparatus according to claim 4, wherein an air-fuel ratio sensor is provided in the merging portion at a section where main flows of the exhaust gas from the exhaust passages converge.

* * * * *